US011574358B2

(12) United States Patent
Milgrom et al.

(10) Patent No.: US 11,574,358 B2
(45) Date of Patent: Feb. 7, 2023

(54) IMPRESSION ALLOCATION SYSTEM AND METHODS USING AN AUCTION THAT CONSIDERS LOSING BIDS

(75) Inventors: Paul R. Milgrom, Stanford, CA (US); Stephan J. Cunningham, Pasadena, CA (US); Marissa R. Beck, Stanford, CA (US)

(73) Assignee: OpenX Technologies, Inc., Pasadena, CA (US)

( * ) Notice: Subject to any disclaimer, the term of this patent is extended or adjusted under 35 U.S.C. 154(b) by 154 days.

(21) Appl. No.: 13/163,417

(22) Filed: Jun. 17, 2011

(65) Prior Publication Data

US 2012/0323701 A1 Dec. 20, 2012

(51) Int. Cl.
*G06Q 30/08* (2012.01)

(52) U.S. Cl.
CPC ..... *G06Q 30/08* (2013.01)

(58) Field of Classification Search
CPC ..... G06Q 30/0207–0277
USPC ..... 705/14.4, 14.71, 14.49
See application file for complete search history.

(56) References Cited

U.S. PATENT DOCUMENTS 7,624,083 B2 11/2009 Micaelian et al.
8,086,518 B1 * 12/2011 Maor ..... G06Q 10/087 705/37
8,326,693 B1 * 12/2012 Chan ..... G06Q 20/381 705/26.4
2002/0082971 A1 6/2002 Le et al.
2003/0055729 A1 * 3/2003 Bezos ..... G06Q 30/08 705/14.31
2005/0197950 A1 * 9/2005 Moya ..... G06Q 40/04 705/37
2008/0052219 A1 * 2/2008 Sandholm et al. ..... 705/37
2010/0100414 A1 4/2010 Lin et al.
2010/0114716 A1 * 5/2010 Heilig ..... G06Q 30/08 705/14.71
2010/0161408 A1 6/2010 Karson et al.
(Continued)

OTHER PUBLICATIONS

Beck, Marissa, Milgrom, Paul, "Adverse-Selection-Free Auctions for Internet Display Adverting", Aug. 18, 2011, 29 pages.
(Continued)

*Primary Examiner* — Chrystina E Zelaskiewicz
(74) *Attorney, Agent, or Firm* — Patent Law Works LLP

(57) ABSTRACT

A system and methods for allocating impressions using an auction comprises a delivery engine, a statistics collector, a forecasting module, and optimization engine and a direct demand source. The delivery engine receives indirect demand, direct demand and optimization information that it uses to allocate impressions and serve ads. The statistics collector is coupled to collect information from the delivery engine and input from the forecasting module. The forecasting module provides information to the optimization to smooth the rate at which direct demand is allocated. The optimization engine receives information from the statistics collector, the forecasting module and the direct demand source to produce optimization information that is used to generate bids for the direct demand. The present invention is particularly advantageous because it preserves the incentive for performance bidders to bid honestly; it eliminates adverse selection against the publisher; and it increases the efficiency and total value produced by the auction.

8 Claims, 17 Drawing Sheets

(56) References Cited

U.S. PATENT DOCUMENTS

| | | | | |
|---|---|---|---|---|
| 2010/0198695 | A1* | 8/2010 | Muthukrishnan et al. | 705/14.71 |
| 2010/0268609 | A1* | 10/2010 | Nolet | G06Q 30/02 705/14.71 |
| 2012/0030034 | A1* | 2/2012 | Knapp | G06Q 30/0275 705/14.71 |
| 2015/0066740 | A1* | 3/2015 | DiCarlo | G06Q 40/04 705/38 |
| 2017/0024778 | A1* | 1/2017 | Knapp | G06Q 30/0277 |

OTHER PUBLICATIONS

Ghosh et al., Bidding for Representative Allocations for Display Advertising, WINE '09, Proceedings of the 5th International Workshop on Internet and Network Economics, 2009, 17 pgs.

International Search Report and Written Opinion for PCT/US12/42074, dated Sep. 6, 2012, 13 pgs.

* cited by examiner

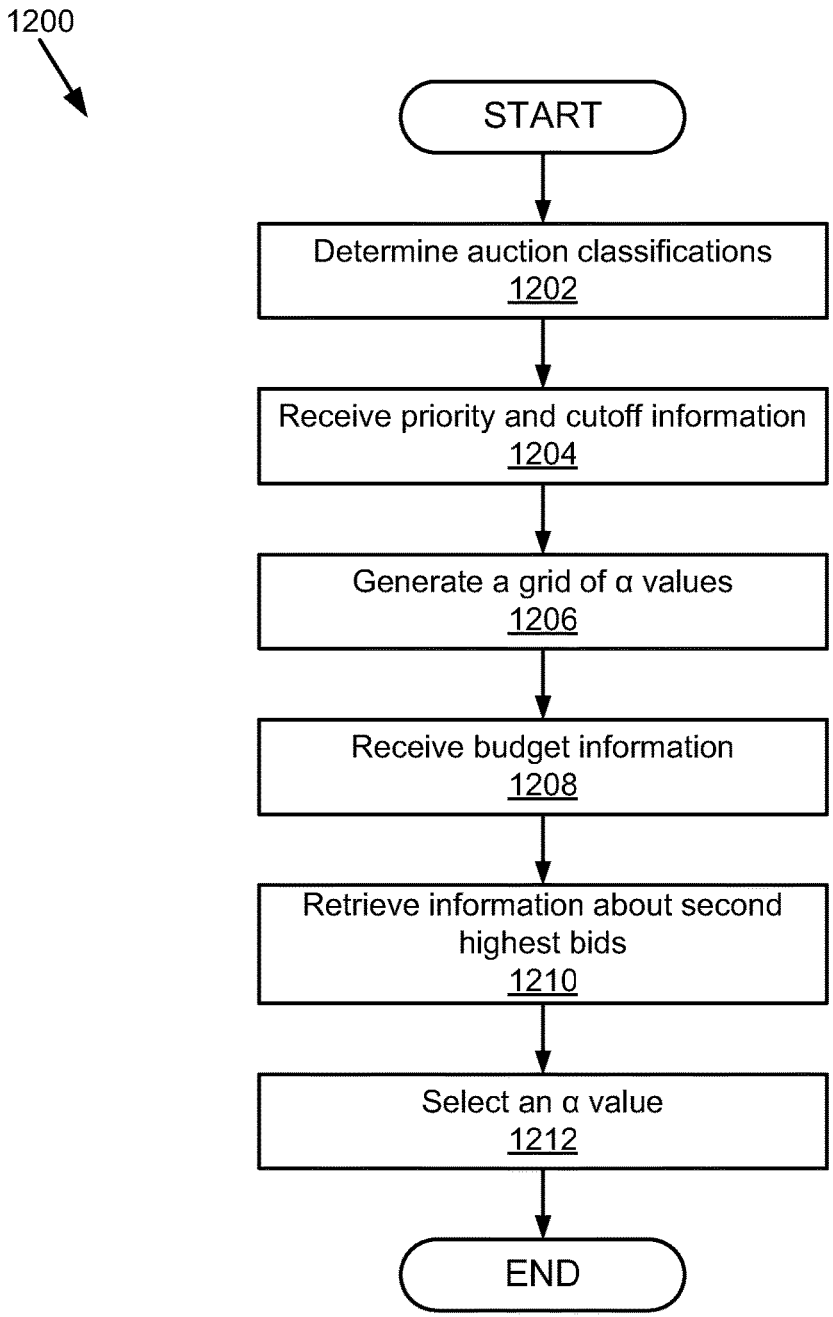
Figure 12 Method for optimizing

Calculating α for each class

IMPRESSION ALLOCATION SYSTEM AND METHODS USING AN AUCTION THAT CONSIDERS LOSING BIDS

BACKGROUND OF THE INVENTION

1. Field of the Invention

The present invention relates to systems and methods for conducting auctions. In particular, the present invention relates to auctions that implement a function that is homogeneous of degree one. Still more particularly, the present invention relates to an auction whose function depends on a second-highest bid. The present invention also relates to systems and methods for allocating impressions or advertisements on web pages.

2. Description of the Related Art

The popularity and use of the Internet, web browsers and sites providing content has grown dramatically over the past decade. With this growth have been dramatic growth and change in advertisements on web pages or impressions, how those impressions are purchased and placed as well as different models for advertising using impressions. Advertisers used to buy guarantees, and then developed performance goals. However, more recently, the suppliers of impressions have new indirect demand sources which are mostly independent bidders ("performance advertisers") that bid for impressions on an impression-by-impression basis. Bids by these independent bidders are sometimes referred to herein as "indirect demand." However, other types of models have been developed. For example, traditional advertisers have hired publishers or distributors to purchase and place impressions. This is often done in the context of a campaign that includes a number of impressions, as well as certain parameters for targets and metrics for performance. The publishers or distributors act on behalf of one or more traditional advertisers, who have been offered certain guarantees about a set of impressions they will be assigned. Bids by these publishers are sometimes referred to herein as "direct demand."

One difficulty is how to balance a marketplace between performance advertisers (indirect demand/buyers) and a publisher's own advertisers (direct demand/buyers). There is not a system that has been effective in allowing direct demand and indirect demand to compete with each other. More specifically, there are three particular problems with existing solutions that prevent them from allowing indirect demand and direct demand to compete with each other. First, there is an adverse selection problem. When direct demand and indirect demand compete, there is a concern about cherry picking where well-informed indirect demand/buyers will take all of the "good" inventory, leaving a direct buyer/demand with the "bad" inventory. Second, there is an under delivery problem. When direct demand and indirect demand compete, there is a concern that indirect demand/buyers will win too much inventory, causing the guaranteed campaigns of the direct demand/buyers to under deliver. Third, there is a need to make the marketplace strategy proof so that indirect demand will not attempt to game the system by submitting false bids to skew the award of impressions. Thus, there is a need for a system for allocating impressions that addresses these problems.

The prior art has attempted to solve this problem by controlling the manner in which the direct buyers submit bids along with the indirect buyers. More specifically, the publisher places bids at random on behalf of the indirect buyers. See Ghosh, Arpita, Preston McAfee, Kishore Papineni and Sergei Vassilvitskii (2009). "Bidding for Representative Allocations for Display Advertising." *Proceedings of the 5th international Workshop on Internet and Network Economics* (*WINE*). However, this solution reduces the effectiveness of targeting of the direct buyers to avoid the adverse selection problem. Thus, in order to avoid adverse selection, the prior art reduces the effectiveness of other targeting.

The selling of an impression is essentially an auction involving common factors and match factors. Common factors are ones that have a similar effect on the values of ad impressions to most advertisers. For example, income is a common factor, because after controlling for other factors, higher income consumers are preferred advertising targets for most advertisers. Match factors are ones that tend to be specific to the advertiser. For example, if a consumer is known presently to be shopping for something specific—such as for a family car or for Italian designer clothing or for hotels in San Francisco—then impressions to that consumer offered now are particularly valuable to firms selling those products. Since advertisers' bids for different impressions reflect all aspects of value, including both common factors and match factors, it has been thought to be impossible to separate the common factor to produce bids for such auction that satisfy the concerns noted above. Any bid that is placed on behalf of an indirect buyer will win more often when all the value factors, including the common factors, are low, and that seems to make adverse selection inescapable.

Existing solutions do not adequately address the need for an impression allocation system that allows direct demand and indirect demand to compete, avoids the adverse selection problem, increases the efficiency of the auction (reduces the under delivery problem), and preserves the incentive for indirect bidders to bid honestly.

SUMMARY OF THE INVENTION

The present invention overcomes the deficiencies and limitations of the prior art at least in part by providing a system and methods for allocating impressions using an auction that considers losing bids. In one embodiment, the auction implements a function that is homogeneous of degree one and/or is a modified second-bid auction or another type of auction. The impression allocation system comprises a delivery engine, a statistics collector, a forecasting module, an optimization engine and a direct demand source. The delivery engine receives indirect demand, direct demand and optimization information that it uses to allocate impressions and serve ads. In particular, the delivery engine operates a modified second-bid auction that matches direct demand or indirect demand to ad calls. The statistics collector is coupled to collect information from the delivery engine and input from the forecasting module. The forecasting module provides information to the optimization to smooth the rate at which direct demand is allocated. The optimization engine receives information from statistics collector, the forecasting module and the direct demand source that it uses to produce optimization information that is used to generate bids for the direct demand. The present invention is particularly advantageous because it preserves the incentive for performance bidders to bid honestly; it eliminates adverse selection against the publisher's direct demand; and it increases the efficiency and total value produced by the auction.

The present invention also includes a number of methods including a method for allocating impressions, a method for auctioning impressions, a method for optimizing the allocation of impressions and a method for determining a plurality of multipliers.

BRIEF DESCRIPTION OF THE DRAWINGS

The present invention is illustrated by way of example, and not by way of limitation in the figures of the accompanying drawings in which like reference numerals are used to refer to the same or similar elements.

FIG. 12 is a flowchart illustrating a method for optimizing allocation of impressions according to one embodiment of the present invention.

DETAILED DESCRIPTION OF THE EMBODIMENTS

Figure 1:
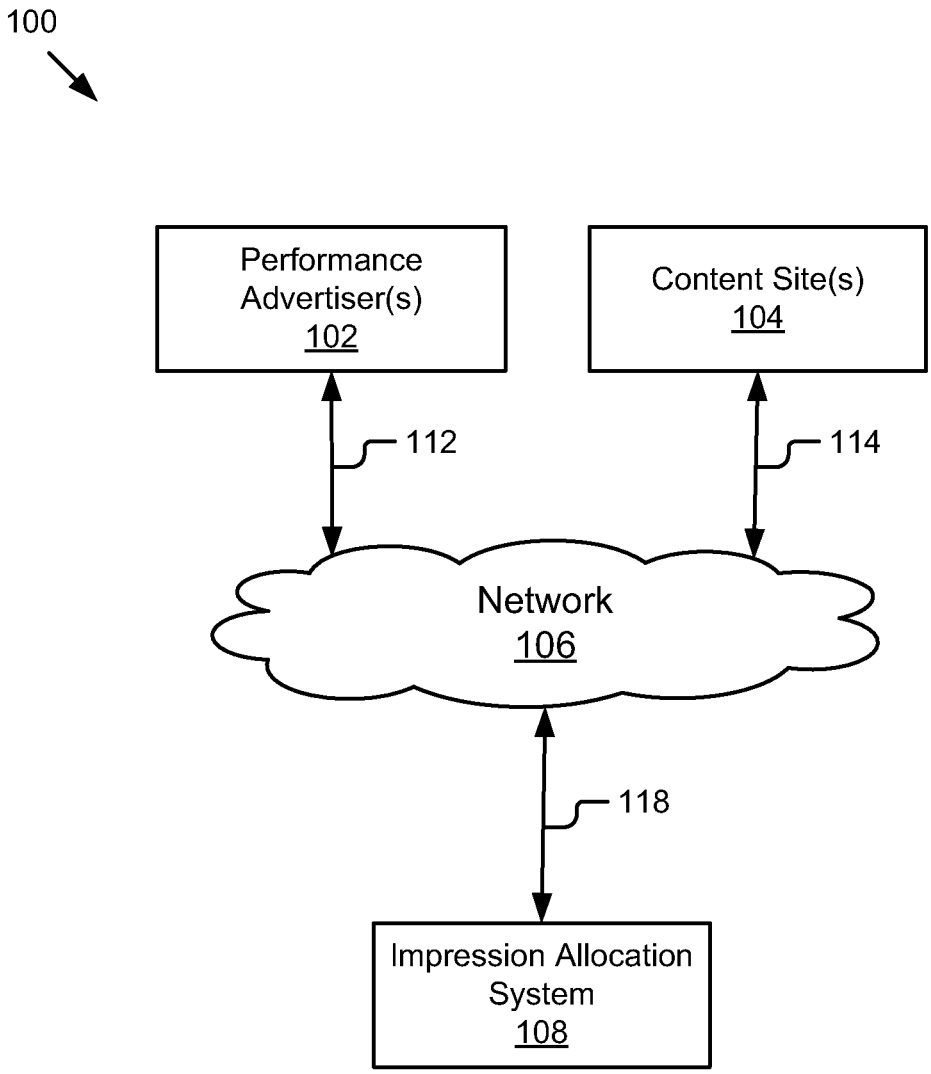
FIG. 1 is high-level block diagram illustrating an environment in which the system operates according to one embodiment of the present invention.

A system and methods for allocating impressions using an auction that considers losing bids are described. In the following description, for purposes of explanation, numerous specific details are set forth in order to provide a thorough understanding of the invention. It will be apparent, however, to one skilled in the art that the invention can be practiced without some of these specific details. In other instances, structures and devices are shown in block diagram form in order to avoid obscuring the invention. For example, the present invention is described in one embodiment below with reference to user interfaces and particular hardware.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Some portions of the detailed descriptions that follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, and magnetic disks, read-only memories (ROMs), random access memories (RAMs), EPROMs, EEPROMs, magnetic or optical cards, flash memories including USB keys with non-volatile memory or any type of media suitable for storing electronic instructions, each coupled to a computer system bus.

The invention can take the form of an entirely hardware embodiment, an entirely software embodiment or an embodiment containing both hardware and software elements. In a preferred embodiment, the invention is implemented in software, which includes but is not limited to firmware, resident software, microcode, etc.

Furthermore, the invention can take the form of a computer program product accessible from a computer-usable or computer-readable medium providing program code for use by or in connection with a computer or any instruction execution system. For the purposes of this description, a computer-usable or computer readable medium can be any apparatus that can contain, store, communicate, propagate, or transport the program for use by or in connection with the instruction execution system, apparatus, or device.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

Finally, the algorithms and displays presented herein are not inherently related to any particular computer or other apparatus. Various general-purpose systems may be used with programs in accordance with the teachings herein, or it may prove convenient to construct more specialized apparatuses to perform the required method steps. The required structure for a variety of these systems will appear from the description below. In addition, the present invention is not described with reference to any particular programming language. It will be appreciated that a variety of programming languages may be used to implement the teachings of the invention as described herein.

System Overview

FIG. 1 illustrates a block diagram of one embodiment of an environment 100 in which the present invention is operable. The environment 100 includes: a performance advertiser 102, a content site 104, a network 106, and an impression allocation system 108. While only a single performance advertiser 102, single content site 104 and single network 106 are shown in FIG. 1, those skilled in the art will recognize that there may be thousands or even millions of performance advertisers 102, content sites 104 or networks 106. FIG. 1 is merely provided for purposes of illustration of the systems 102, 104 and 106 that cooperate with the present invention.

The performance advertiser 102 is the computing system of an independent bidder that bids for impressions on an impression-by-impression basis. The performance advertiser 102 is coupled by signal line 112 to the network 106 for communication with the impression allocation system 108. The performance advertiser 102 is coupled to the impression allocation system 108 to send bids on impressions, ad content, advertising target information, price, or any other information related to the impression or necessary to serve the ad.

The content site 104 is a computing device for hosting a website with any type of content. The content site is a publishing website that serves web pages including ad content. The content site 104 sends ad requests to the impression allocation system 108 via network 106 and receives served ads in response. The content site 104 coupled by signal line 114 to the network 106 and thus the impression allocation system 108.

The network 106 is a conventional type, wired or wireless, and may have any number of configurations such as a star configuration, token ring configuration or other configurations known to those skilled in the art. Furthermore, the network 106 may comprise a local area network (LAN), a wide area network (WAN) (e.g., the Internet), and/or any other interconnected data path across which multiple devices may communicate. In yet another embodiment, the network 106 may be a peer-to-peer network. The network 106 may also be coupled to or includes portions of a telecommunications network for sending data in a variety of different communication protocols. In yet another embodiment, the network 106 includes Bluetooth communication networks or a cellular communications network for sending and receiving data such as via short messaging service (SMS), multimedia messaging service (MMS), hypertext transfer protocol (HTTP), direct data connection, WAP, email, etc.

The impression allocation system 108 is coupled by signal line 118 to the network 106 for communication and interaction with the performance advertisers 102 and the content sites 104. The impression allocation system 108 receives indirect demand from the performance advertisers 102. The impression allocation system 108 receives ad requests from and serves ads to the content sites 104. The operation of the impression allocation system 108 will be described in more detail below with reference to FIG. 2. The impression allocation system 108 is particularly advantageous because it preserves the incentive for performance advertisers 102 to bid honestly, it eliminates adverse selection against the publishers and it increases the efficiency and value produced by the auction. More specifically, the impression allocation system 108 implements a modified second-bid auction or another type of auction that increases the profits earned by performance advertisers 102, increases the average price paid by performance advertisers 102 and preserves the total value of matches for traditional advertisers (direct demand).

Impression Allocation System 108

Figure 2:
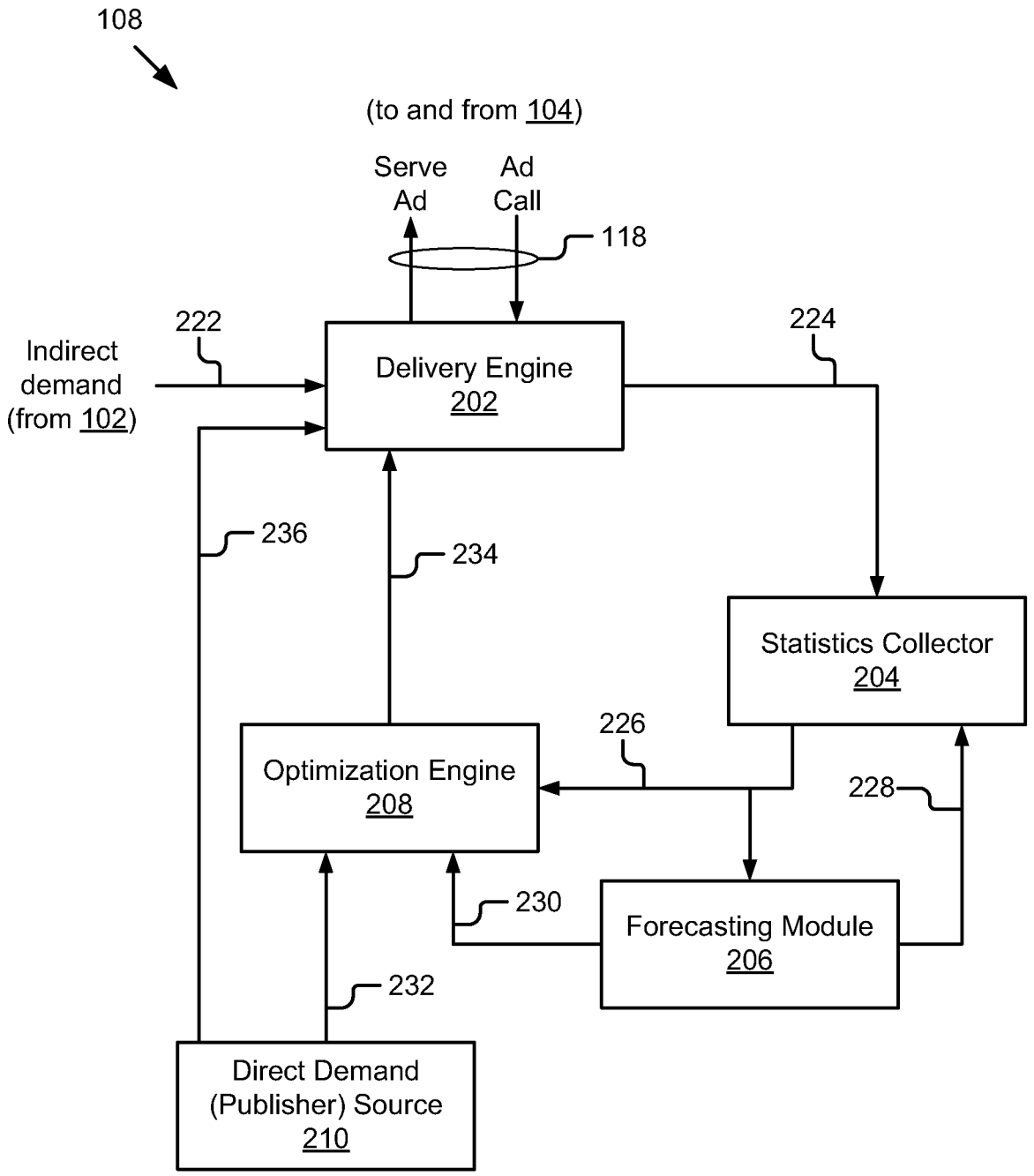
FIG. 2 is a high-level block diagram illustrating an impression allocation system according to a first embodiment of the present invention.

Referring now to FIG. 2, an embodiment for the impression allocation system 108 is shown. This embodiment of the impression allocation system comprises a delivery engine 202, a statistics collector 204, a forecasting module 206, an optimization engine 208 and a direct demand source 210.

The delivery engine 202 is responsible for processing impressions. The delivery engine 202 is coupled for communication with the content sites 104 via signal line 118 to receive ad calls and serve ads. The delivery engine 202 also receives indirect demand, direct demand, and optimization information. The delivery engine 202 is coupled to signal line 222 to receive the indirect demand from the performance advertisers 102, coupled to signal line 236 to receive the direct demand from the direct demand source 210, and coupled to signal line 234 to receive the optimization information from the optimization engine 208. The delivery engine 202 processes this information and selects a bid to be served as an ad. As has been noted above, the delivery engine 202 advantageously runs a modified second-bid auction to determine the winning bid. In other embodiments, the delivery engine 202 advantageously runs other types of auctions. The delivery engine 202 also uses the information from the direct demand source 210 and the optimization engine 208 to generate bids for the direct campaigns. The delivery engine 202 will be described in more detail below with reference to FIG. 4.

The statistics collector 204 is a module for storing and processing impression information for future use. The statistics collector 204 is coupled to the delivery engine 202 by signal line 224 to receive impression information regarding auction results, ad calls received, ads served, losing bids, impression type, etc. The statistics collector 204 processes this information and stores it so that it is readily available for use by the forecasting module 206 and the optimization engine 208. The statistics collector 204 is coupled for communication with the forecasting module 206 and the optimization engine 208 by signal line 226. In one embodiment, the statistics collector 204 stores the information in a plurality of formats including a real-time format, a near-term format and a long-term format. In other embodiments, the statistics collector 204 modifies the data in these formats as additional information is received from the delivery engine 202. The statistics collector 204 will be described in more detail below with reference to FIG. 5. An example of the data provided by the statistics collector 204 includes impression information (ad, time, URL, page id, screen, geographic data); campaign information, publisher information, bid information (winning bid, losing bid, price, etc.), type, etc.

The forecasting module 206 is software and routines for providing control information to the optimization engine 208. The forecasting module 206 estimates the number of future impressions (a forecast) a campaign can expect given a set of part of the constraints and start and end times. The forecasting module 206 also estimates an available number of impressions (availability) considering competition for the same pool of impressions. By definition, the availability number is always less than or equal to the forecast number. The forecasting module 206 uses historical data received from the statistics collector 204 to predict future trends. The forecasting module 206 is coupled by signal line 226 to the statistics collector 204 to retrieve or receive any information necessary for his computations. In one embodiment, the forecasting module stores up to 30 days worth of data for nearly all targeting constraints. In another embodiment, the forecasting module 206 utilizes real-time and near-term information from the statistics collector 204. In one embodiment, the forecasting module 206 monitors for overbooking (e.g., when the availability number reaches zero). In another embodiment, the forecasting module 206 provides curves or controls to the optimization engine 208 so that the impressions are placed in the time and manner desired by the direct campaign buyer. The forecasting module 206 is also coupled by signal line 228 to the statistics collector 204 to provide updated information or corrections to the data stored by the statistic collector 204.

The optimization engine 208 is software and routines for managing campaigns and making sure that impression guarantees provided to direct demand advertisers are satisfied. More specifically, the optimization engine 208 is coupled to statistics collector 204 by signal line 226 to receive information about impressions that were won by campaigns that the optimization engine 208 is managing. The optimization engine 208 produces and sends signals that are used to generate bids by the delivery engine 202. The optimization engine 208 sends information about the priority or importance of an impression to a campaign, the type of impression for the campaign, and a multiplier for the campaign. These signals are generated from priority information, budget smoothing information, availability information, forecasts information, and historical information. The optimization engine 208 is coupled by signal line 226 to receive historical information from the statistics collector 204. The optimization engine 208 is coupled by signal line 230 to the forecasting module 206 to receive availability and forecasting information. The optimization engine 208 is coupled by signal line 232 to the direct demand source 210 to receive campaign information such but not limited to priority, media, price, competitor blocks, volume, reserve price etc. One embodiment of the optimization engine 208 will be described in more detail below with reference to FIG. 6.

The direct demand source 210 is associated with one or more publishers and provides the information about impressions and campaigns for traditional advertisers that have a predefined relationship with the publisher. The direct demand source 210 includes ad content, campaign information, etc. The direct demand source 210 is coupled by signal line 236 to provide this information to the delivery engine 202. The direct demand source 210 is also coupled by signal line 232 to provide a smaller subset of data to the optimization engine 208. For example, the demand source 210 provides campaign information, impression information and other data to the delivery engine 202 while it only provides a more limited set of data such as priority information to the optimization engine 208.

Figure 3:
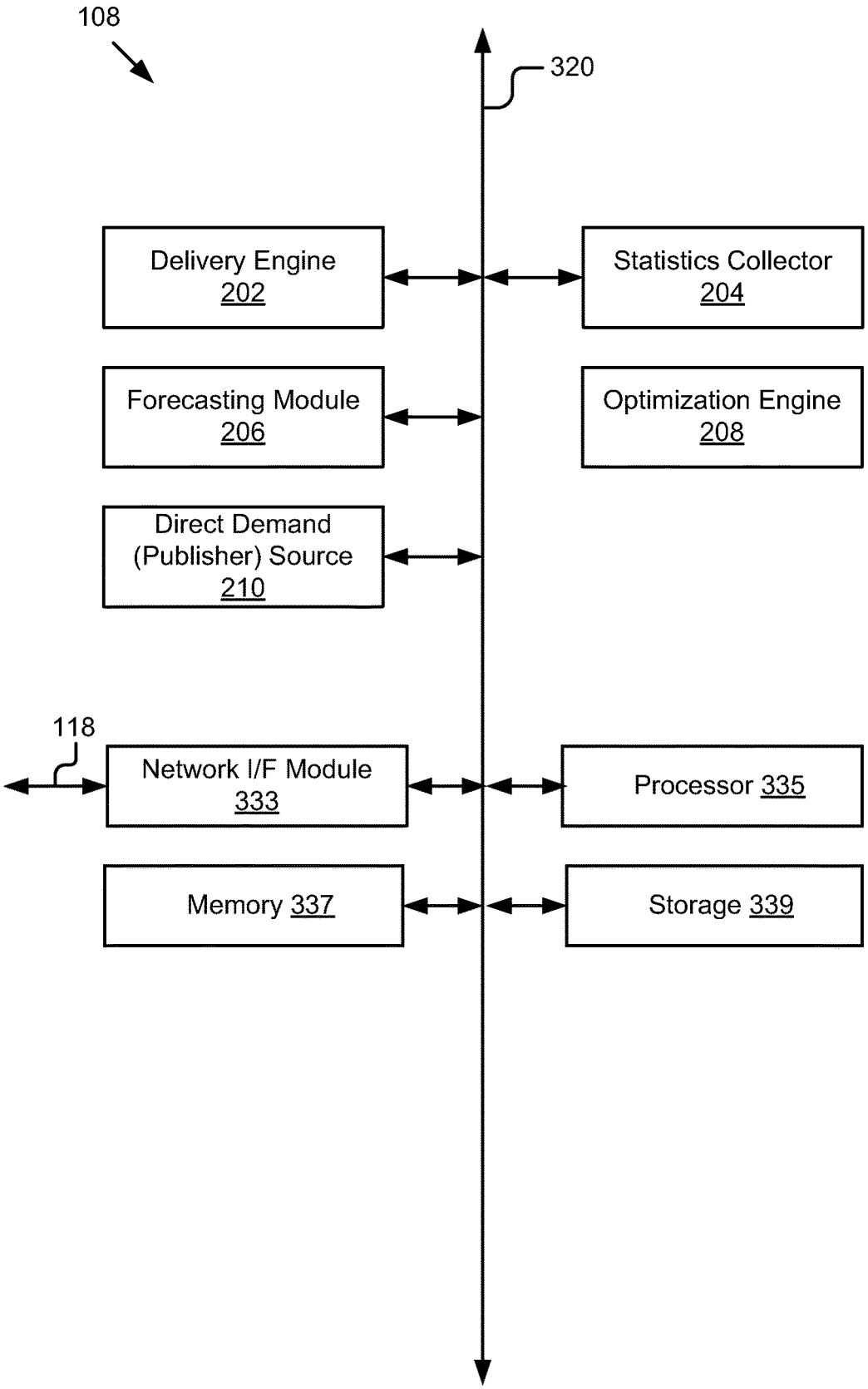
FIG. 3 is a high-level block diagram illustrating the impression allocation system according to a second embodiment of the present invention.

Referring now to FIG. 3, a second embodiment of the impression allocation system 108 will be described. In this embodiment, impression allocation system 108 comprises: the delivery engine 202, the statistics collector 204, the forecasting module 206, the optimization engine 208, the direct demand source 210, a network interface module 333, a processor 335, a memory 337 and storage 339. In FIG. 3, like reference numerals have been used to reference like components with the same or similar functionality that has been described above with reference to FIG. 2. Further, since those components have been described above that description will not be repeated here. However, it should be noted that in this embodiment, the delivery engine 202, the statistics collector 204, the forecasting module 206, the optimization engine 208, and the direct demand source 210 are modules coupled by bus 320 for communication and interaction with each other as well as the network interface module 333, processor 335, memory 337 and storage 339.

The network interface module 333 is coupled to network 106 by signal line 118 and bus 320. The network interface module 333 includes ports for wired connectivity such as but not limited to USB, SD, or CAT-5, etc. The network interface module 333 links the processor 335 to the network 106 that may in turn be coupled to other processing systems. The network 106 may comprise a local area network (LAN), a wide area network (WAN) (e.g., the Internet), and/or any other interconnected data path across which multiple devices may communicate. The network interface module 333 provides other conventional connections to the network 106 using standard network protocols such as TCP/IP, HTTP, HTTPS and SMTP as will be understood to those skilled in the art. In other embodiments, the network interface module 333 includes a transceiver for sending and receiving signals using WIFI, Bluetooth® or cellular communications for wireless communication.

The processor 335 comprises an arithmetic logic unit, a microprocessor, a general purpose controller or some other processor array to perform computations and provide electronic display signals to a display device. The processor 335 is coupled to the bus 320 for communication with the other components. Processor 335 processes data signals and may comprise various computing architectures including a complex instruction set computer (CISC) architecture, a reduced instruction set computer (RISC) architecture, or an architecture implementing a combination of instruction sets. Although only a single processor is shown in FIG. 3, multiple processors may be included. It will be obvious to one skilled in the art that other processors, operating systems, sensors, displays and physical configurations are possible.

The memory 337 stores instructions and/or data that may be executed by processor 335. The memory 337 is coupled to the bus 320 for communication with the other components. The instructions and/or data may comprise code for performing any and/or all of the techniques described herein. The memory 337 may be a dynamic random access memory (DRAM) device, a static random access memory (SRAM) device, flash memory or some other memory device known in the art.

In one embodiment, storage 339 stores data, information and instructions used by the delivery engine 202, the statistics collector 204, the forecasting module 206, the optimization engine 208, and the direct demand source 210. Storage 339 is a non-volatile memory or similar permanent storage device and media such as a hard disk drive, a floppy disk drive, a CD-ROM device, a DVD-ROM device, a DVD-RAM device, a DVD-RW device, a flash memory device, or some other mass storage device known in the art for storing information on a more permanent basis. The data storage 339 is coupled by the bus 320 for communication with other components of the impression allocation system 108.

One or more of the delivery engine 202, the statistics collector 204, the forecasting module 206, the optimization engine 208, and the direct demand source 210 are software or routines executable on the processor 335. In another embodiment, one or more of the delivery engine 202, the statistics collector 204, the forecasting module 206, the optimization engine 208, and the direct demand source 210 store data that, when executed by the processor 335, causes the collectors/modules to perform the operations described below. In yet another embodiment, one or more of the delivery engine 202, the statistics collector 204, the forecasting module 206, the optimization engine 208, and the direct demand source 210 are instructions executable by the processor 335 to provide the functionality described below with reference to FIGS. 4-14. In still another embodiment, one or more of the delivery engine 202, the statistics collector 204, the forecasting module 206, the optimization engine 208, and the direct demand source 210 are stored in the memory 337 and are accessible and executable by the processor 335.

Delivery Engine 202

Figure 4:
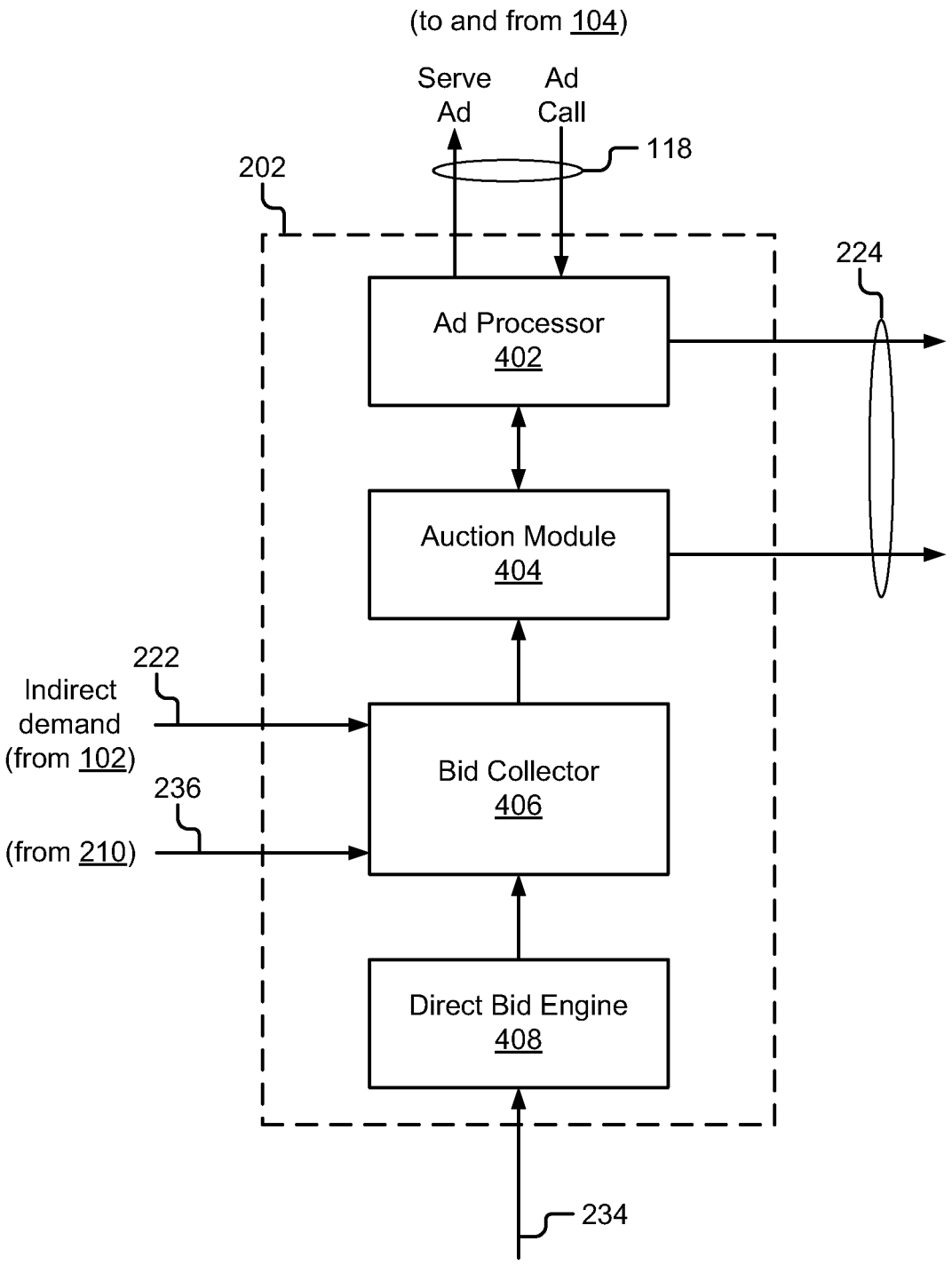
FIG. 4 is a block diagram illustrating a delivery engine according to one embodiment of the present invention.

Referring now to FIG. 4, an embodiment of the delivery engine 202 will be described. In this embodiment, the delivery engine 202 comprises an ad processor 402, an auction module 404, a bid collector 406 and a direct bid engine 408.

The ad processor 402 handles the technical mechanics of receiving an ad call, requesting an impression to send in response, and serving up an ad in response to the received ad call. The operation of the ad processor 402 will be described for handling a single ad call; however, those skilled the art will recognize that the ad processor 402 can be scaled to handle thousands or millions of ad calls. The ad processor 402 is coupled to signal line 118 to receive an ad call. The processor 402 is also coupled to signal line 118 to serve ads. In the simplest case, the ad processor 402 receives an ad call and stores information about the ad call. For example, the information stored includes the source of the ad call, the site of the ad call, information about advertisement placement and other metrics. The ad processor 402 then issues a request to the auction module 404 for an impression to be served in response to the ad call. In response, the auction module 404 returns an impression to be served. The ad processor 404 serves the received impression and records information about the serving of the impression. The ad processor 402 also outputs on signal line 224 information about: 1) the ad call; 2) the impression that was served; 3) the serving of the ad; and 4) any error information about the serving of the ad. The ad processor 402 outputs this information to the statistics collector 204.

The auction module 404 performs an auction as will be described in more detail below and as a result of the auction identifies an impression. As has been described above, the impression identified as a result of the auction is sent to the ad processor 402 so it can be served in response to the ad call. The operation of the auction module 404 is described in more detail below with reference to FIG. 7-11C. The auction module 404 is coupled to the bid collector 406 to receive bids in response to any ad call that is received from the ad processor 402. The auction module 404 also records information about the auction such as the highest bidder, the second-highest bidder, information about the bids, information about the prices and various other metrics related to the auction. This information is output on signal line 224 to the statistics collector 204 for storage and use by other modules of the impression allocation system 108.

The bid collector 406 is software and routines for gathering bids and sorting them for submission to the auction module 404 in response to an auction. The bid collector 406 has an input coupled to signal line 222 to receive bids from independent bidders or performance advertisers. The bid collector 406 is also has an input coupled to signal line 236 to receive bids directly from the direct demand source 210. In one embodiment, the bid collector 406 receives information about the campaign from the direct demand source 210 to generate events. The bid collector 406 also has an input coupled to the output of the direct bid engine 408. The direct bid engine 408 generates bids based upon optimization information from the optimization engine 208. The bid collector 406 receives the bids for impressions from these sources. The bids also include information about class type to which the bids are related. In response to a request from the auction module 404 for bids meeting particular parameters, the bid collector 406 searches its storage and sends bids that match the request from the auction module 404 for consideration in the auction.

The direct bid engine 408 generates bids based upon optimization information from the optimization engine 208. In one embodiment, the direct bid engine 408 receives priority values that are used to generate bids from the optimization engine 208. The direct bid engine 408 is advantageously adaptive in response to the information from the optimization engine 208. The directive bid engine 408 is used to generate bids for campaigns from the direct demand source 210. The direct bid engine 408 advantageously generates bids with different prices based upon the information from the optimization engine 208. Depending on factors such as priority, forecasts, availability provided by the optimization engine 208, the direct bid engine 408 generates bids and sends them to the bid collector 406 for consideration in the auction. The direct bid engine 408 is coupled to signal line 234 to receive the information from the optimization engine 208. The direct bid engine 408 has an output coupled to an input of the bid collector 406.

Statistics Collector 204

Figure 5:
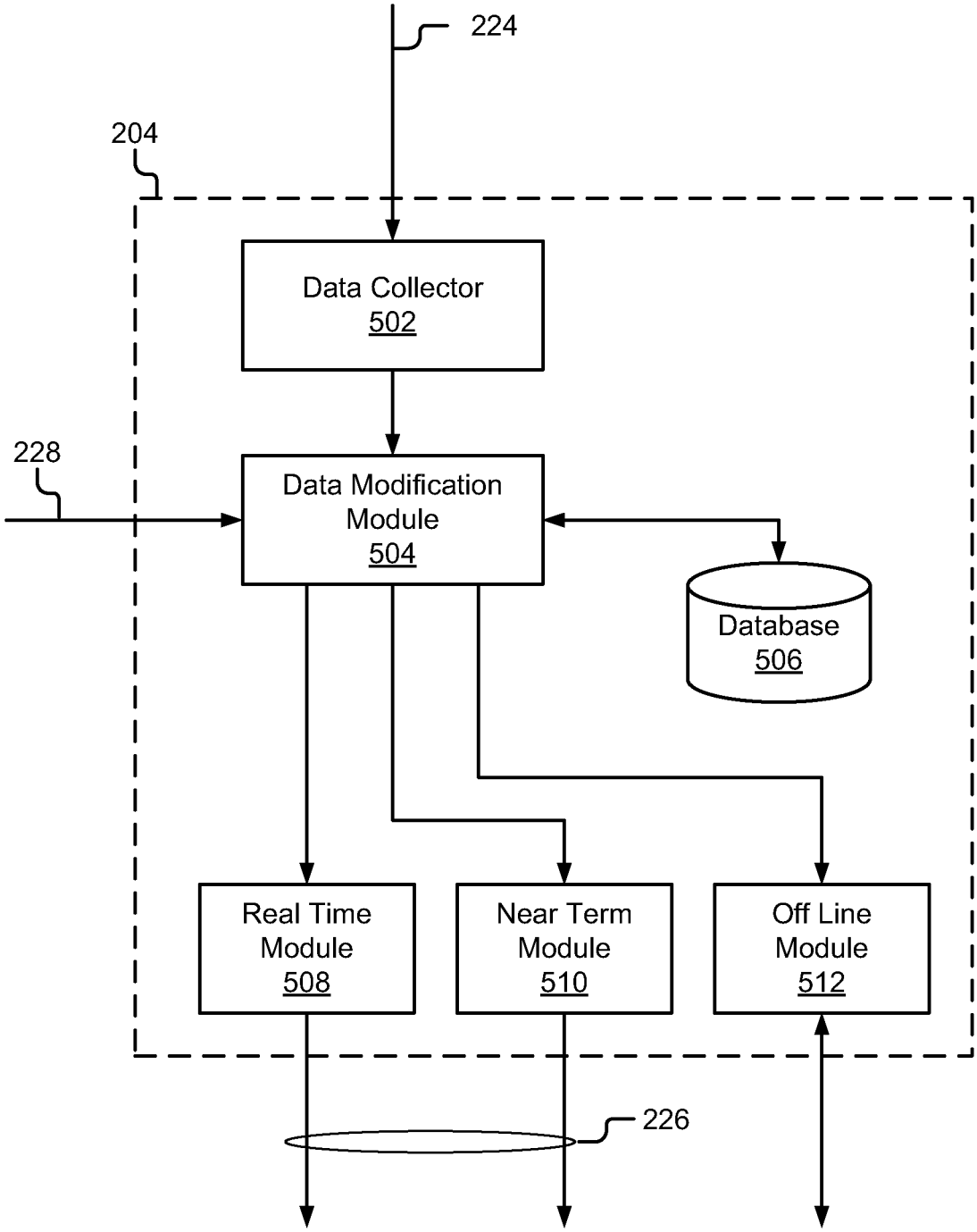
FIG. 5 is a block diagram illustrating a statistics collector according to one embodiment of the present invention.

Referring now to FIG. 5, an embodiment of the statistics collector 204 will be described. In this embodiment, the statistics collector 204 comprises a data collector 502, a data modification module 504, a database 506, a real-time module 508, a near-term module 510 and an off-line module 512.

The data collector 502 is temporary storage for information received from the delivery engine 202 on signal line 224. The data collector 502 has an input to receive information from the delivery engine 202. Since the information is received from both the ad processor 402 and the auction module 404, this information needs to be temporarily stored until it can be processed by the data modification module 504.

The data modification module 504 is responsible for processing and transferring information about impressions and the auction from the data collector 502. The data modification module 504 receives the information from the data collector 502 and stores it immediately in the real-time module 508. The data modification module 504 continues to process the information and after some processing stores it in the near-term module 510. The output of the real-time module 508 and the near-term module 510 are provided on signal line 226 to the forecasting module 206 and the optimization engine 208. These real-time and near-term modules 508, 510 are also responsive to requests for additional information from these modules 206, 208. After additional processing, the information is stored in the off-line module 512. For example, information that is immediately available about ad calls, corresponding served ads and information about completed auctions is stored in the real-time module 508. After additional processing by the data modification module 504, the specific ad call, corresponding served ad, and corresponding auction performed to identify the ad are grouped together and stored in the near-term module 510. After yet further processing by the data modification module 504, additional information about whether the impression was actually delivered and presented or other information is added to the record and the information is moved to off-line module 512. The data modification module 504 is also coupled to signal line 228 to receive corrections or modifications to the data from the forecasting module 206. Based on input information on signal line 228, the data modification module 504 modifies the information in the off-line module 512. In one embodiment, the off-line module 512 is accessible by APIs and other user interfaces and tools. The data modification module 504 also communicates with the database 506 to store information related to each of the modules 508, 510 and 512.

Optimization Engine 206

Figure 6:
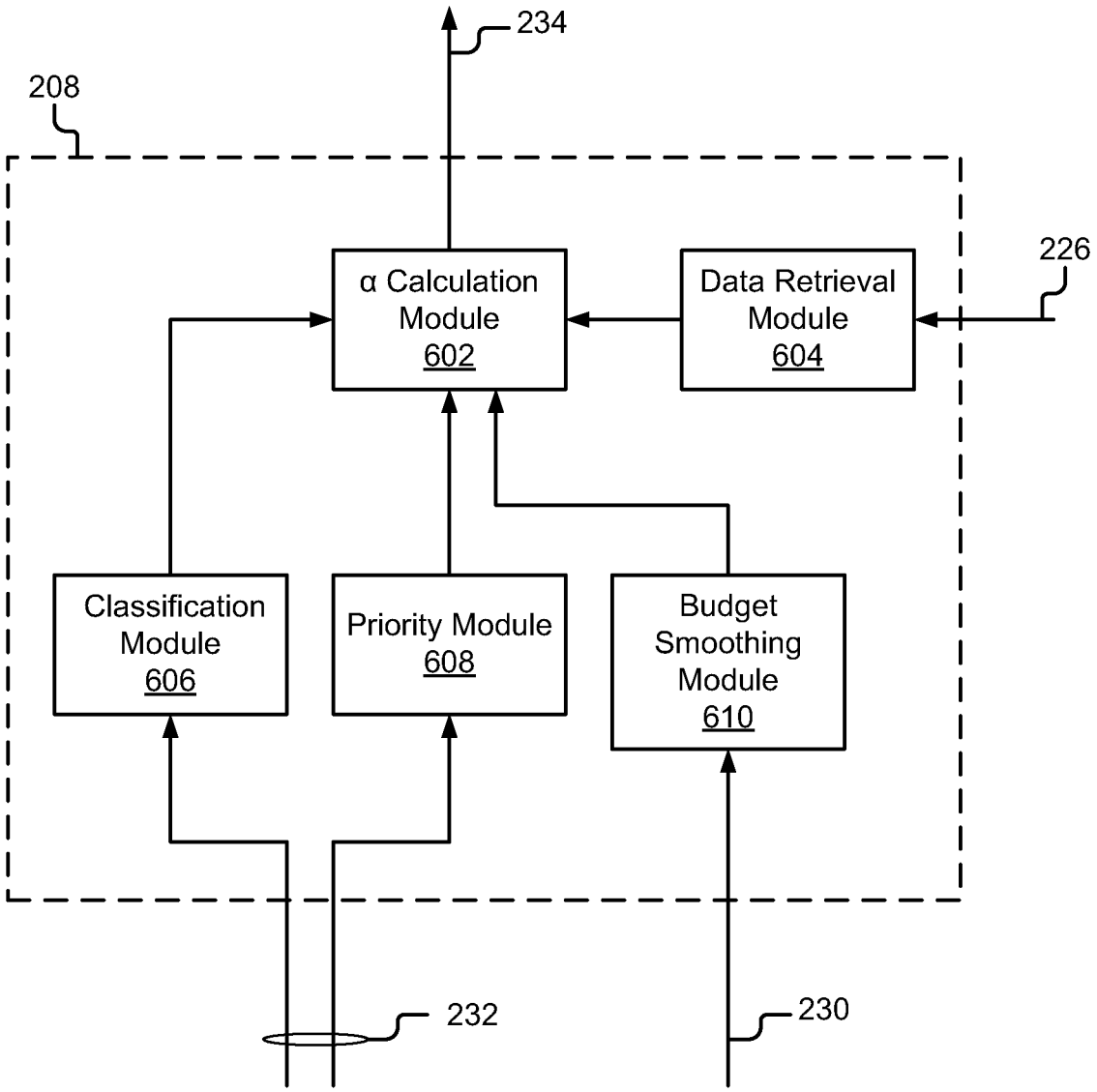
FIG. 6 is a block diagram illustrating an optimization engine according to one embodiment of the present invention.

Referring now to FIG. 6, an embodiment of the optimization engine 206 will be described. One embodiment of the optimization engine 208 includes a multiplier ($\alpha$) calculation module 602, a data retrieval module 604, a classification module 606, a priority module 608, and a budget smoothing module 610.

The multiplier calculation module 602 is coupled to receive classification information from the classification module 606, priority information from the priority module 608, forecasting and availability information from the budget smoothing module 610 and historical information from the data retrieval module 604. The multiplier calculation module 602 uses this information to generate a set of parameters that are sent to and used by the direct bid engine 408 of the delivery engine 202 to generate bids for direct campaigns. In one embodiment, the set of parameters includes a priority value and cutoff, an alpha multiplier value, a reserved value and a sell through value. The multiplier ($\alpha$) is a number greater than one. This mitigates cherry picking by increasing the second highest value. The multiplier ($\alpha$) is also influenced by sell-through rates. The higher the sell-through, the larger the multiplier ($\alpha$). This controls under delivery risk. Under delivery is also mitigated by sell-through rate. If a publisher's inventory is sold through at a certain rate, indirect demand is bypassed. In one embodiment, the multiplier calculation module 602 is adapted a dynamic based upon information received from the data retrieval module 604, forecast availability information received from the budget smoothing module 610 and classification information received from the classification module 606. The output of the multiplier calculation module 602 is provided on signal line 234 to the delivery engine 202. The operation of the multiplier calculation module is described in more detail below with reference to FIGS. 12-14.

The data retrieval module 604 has an input coupled to signal line 226 to retrieve data from the statistics collector 204. The output of the data retrieval module 604 is provided as input to the multiplier calculation module 602. The data retrieval module 604 retrieves any historical information about impressions, auctions, bids, ad calls or served ads needed by the multiplier calculation module 602 from the real-time module 508 or the near-term module 510 of the statistics collector module 204.

The classification module 606 has an input coupled to signal line 232 to receive information about campaigns from the direct demand source 210. The classification module 606 retrieves any necessary campaign information from the direct demand source 210. In particular, the classification module 606 provides the classification type of the impression and campaign to the multiplier calculation module 602.

The priority module 608 also has an input coupled to signal line 232 to retrieve priority information about the campaign from the direct demand source 210. In one embodiment, the priority module 608 provides the priority value and a cutoff value to the multiplier calculation module 602. In another embodiment, the priority value and cutoff were calculated by the multiplier calculation module 602 and the priority module 608 provides the information that allows the multiplier calculation module 602 to make that determination. The output of the priority module 608 is coupled to an input of the multiplier calculation module 602 to provide this priority information.

The budget smoothing module 610 has an input coupled to signal line 230 to retrieve forecast and availability information from the forecasting module 206. The budget smoothing module 610 provides forecast and availability information that is used by the multiplier calculation module 602 to modify the parameters provided to the delivery engine 202. In one embodiment, the budget smoothing module 610 is provided with a set of curves that allow for the control of placement of impressions over time. For example, there may be a set of three curves, one conservative, one normal and one aggressive. Each of the curves will cause the impressions from the direct campaign to be placed more conservatively or aggressively. These curves are provided by the budget smoothing module 610 to the multiplier calculation module 602 so that it may modify the parameters so that the ads are placed in accordance with the input curve. In another embodiment, the budget smoothing module 610 provides an administrator with control on the placement of impressions. In effect, the budget smoothing module 610 includes settings that can be modified at different times to affect the placement rate of impressions. This acts as a control dial which the administrator can turn up and increase impression placement if the rate of placement is below that for the campaign or alternatively can be turned down to decrease the ad placement rate if the current placement rate for the campaign is above that of the campaigns goals.

Methods

Figure 7:
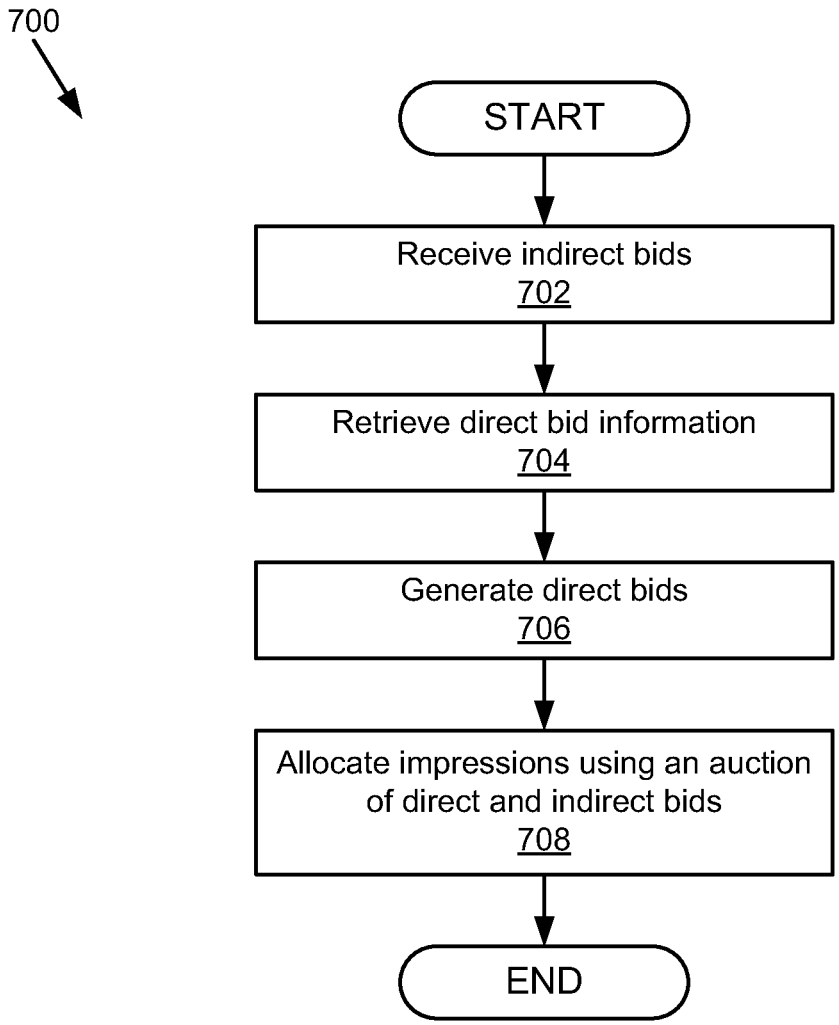
FIG. 7 is a flowchart illustrating a general method for allocating impressions according to one embodiment of the present invention.

Referring now to FIG. 7, a general method 700 for allocating impressions according to one embodiment of the present invention will be described. The method begins by receiving 702 indirect bids. Next, the method receives 704 direct bid information. The direct bid information includes priority information and a multiplier ($\alpha$). Using the received direct bid information, the method generates 706 direct bids. Finally, the method allocates 708 impressions using an auction that includes the indirect bids received in step 702 and the direct bids generated in step 706.

Figure 8:
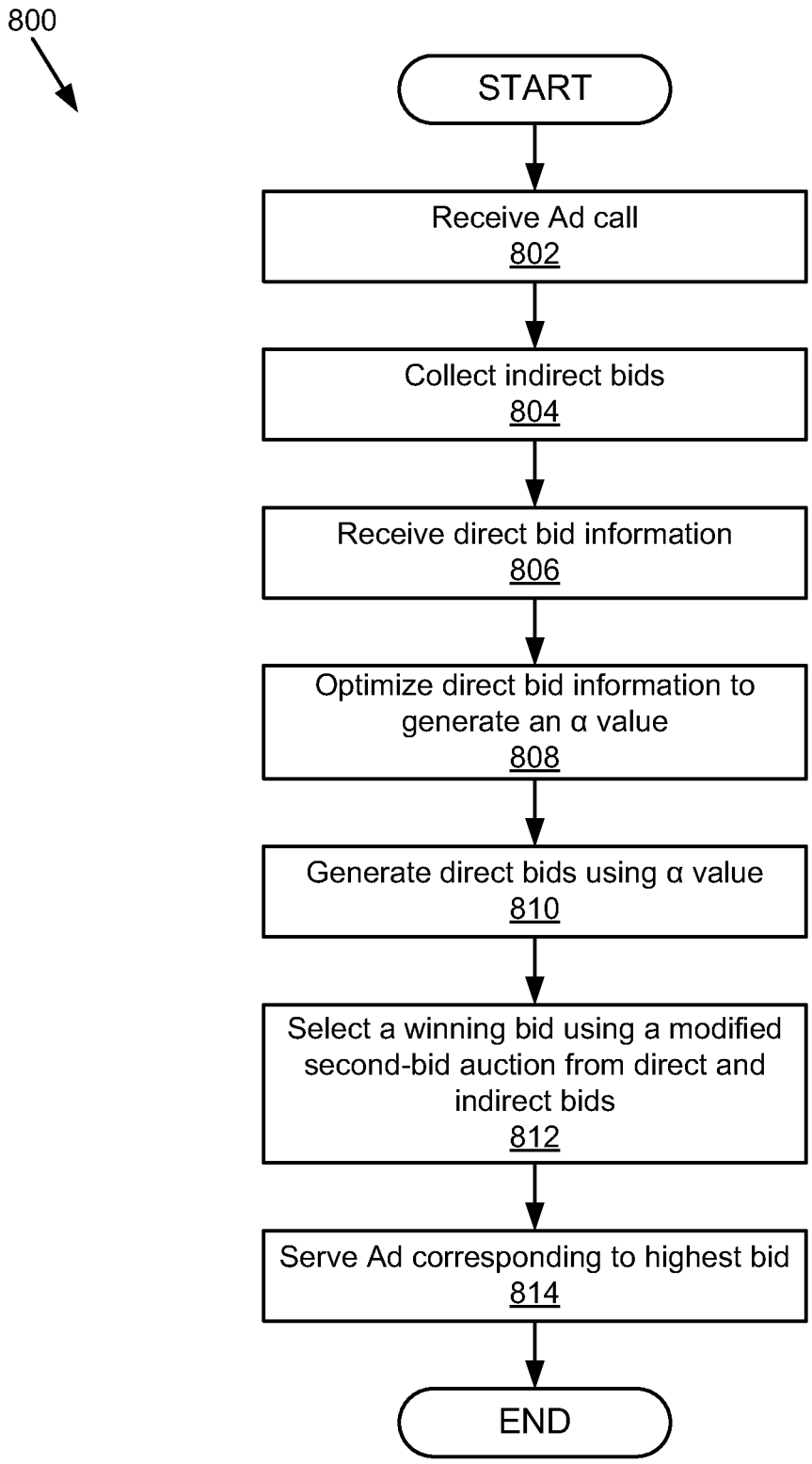
FIG. 8 is a flowchart illustrating a specific method for allocating impressions according to one embodiment of the present invention.

Referring now to FIG. 8, a specific method 800 for allocating impressions according to one embodiment of the present invention will be described. The method begins 800 by receiving 802 an ad call. For example, the ad processor 402 of the delivery engine 202 receives an ad call from a content site 104. The ad call includes an impression description with type or value k. The impression descriptions are classified into different types with each type having a set of specific attributes such that the impressions served by the delivery engine 202 must match the type or value of k received in the ad call. The present invention distinguishes between different types of impressions if they have distinct bid distributions in the auction data. These classifications cannot overlap. Every impression must fit into exactly one class. One embodiment of the present invention differentiates based on the descriptions requested by the campaigns (category, ad size, domain, user characteristics, etc) and does not use information that is not part of these descriptions. Then indirect bids from performance advertisers 102 are collected 804 by the delivery engine 202 for use in the auction mechanism of the present invention. These indirect bids include information about the impression description that is used for classification and a price. In another embodiment, the indirect bids include information such as but not limited to advertiser, publisher, ad size, and user fields (IP address, screen size, geography, language, etc.) The method 800 also receives direct bid information 806 from the direct demand source 210. For example, the direct bid information includes the targeting parameters (such as content category, ad size, user geo location, etc), the campaign's prioritization, the price the direct demand buyer is paying for the inventory, and the campaign's start and end dates. The method 800 also optimizes 808 the direct bid information to generate a multiplier ($\alpha$) value. Direct bids are then generated 810 using the direct bid information and the multiplier ($\alpha$) value. Next, the method 800 selects 812 a winning bid using a modified second-bid auction that includes direct bid and indirect bids that match the value of k received in the ad call. Finally, the method 800 completes by serving 814 the ad corresponding to the highest bid in the auction of step 812.

Auctions

The present invention advantageously uses an auction mechanism for selling items, in particular impressions. The auction mechanism includes the following constraints. First, the auction needs to be strategy proof such that the performance advertisers are incentivized to bid honestly and accurately. Secondly, the auction needs to be free of adverse selection ("cherry picking") such that the performance advertisers do not secure all the "good" impressions leaving only the less valuable impressions for the traditional advertisers or direct demand.

The present invention provides an auction mechanism for addressing these concerns. The auction mechanism generates bids based on losing bids. More specifically, the auction mechanism generates bids that are a function of losing bids and a function homogeneous of degree one (multiplicatively scalable). Still more specifically, the auction mechanism generates bids based on a second highest bid. In the context of impressions, the auction mechanism generates bids for publishers that are bidding on behalf of traditional advertisers. Since the bids generated for publishers are based upon losing bids or the second highest bid, they preserve the incentive of performance bidders to bid honestly and accurately (preserve the strategy proof characteristic). For example, the auction mechanism generates bids that are a multiplier ($\alpha$) times a second highest value ($V_2$) or $\alpha \cdot V_2$. For this discussion we assume that value (V) is the product of a common factor (C) and a match factor (M) so that $V=C \cdot M$, where C=a common factor or information known to everyone and M=a match factor that is a private value or specific information known by the bidder. In this case, the mechanism determines that that the publisher wins the auction if $V_1 < \alpha \cdot V_2$ $M_1 \cdot C < \alpha \cdot M_2 \cdot C$, which reduced to $M_1 < \alpha \cdot M_2$, or $M_1/M_2 < \alpha$ which means that the event that the publisher wins the auction does not depend on C.

For this discussion, we assume that there is a power law distribution (80/20 rule) of the match factor. This implies that, compared to the method of setting aside a fraction of impressions, this mechanism benefits all participants. For the seller, it raises the average price paid by performance advertisers by a factor of alpha. For the performance bidders, it raises the profits earned by allowing those advertisers to acquire their most valuable impressions. And for the traditional advertisers, it eliminates adverse selection, because the publisher's bid rises when the performance advertisers' bids rise. Additionally, this auction is immune to manipulation by low, intentionally losing bids submitted by performance advertisers, making the mechanism strategy-proof in a more extended sense than is usual for that term.

The present invention includes at least three embodiments for implementing the above auction mechanism which are described below with reference to FIGS. 9-11C and in the context of allocating impressions. However, those skilled in the art will recognize that the above auction mechanism can be applied to the auction of any type of item, and that impressions are just on type of item. The auction mechanism of the present invention may also be used to conduct auction of a variety of other types of items such auctions for consumer items where the "direct" bidders are expert evaluators and the indirect bidders are regular customers of the seller.

Figure 9:
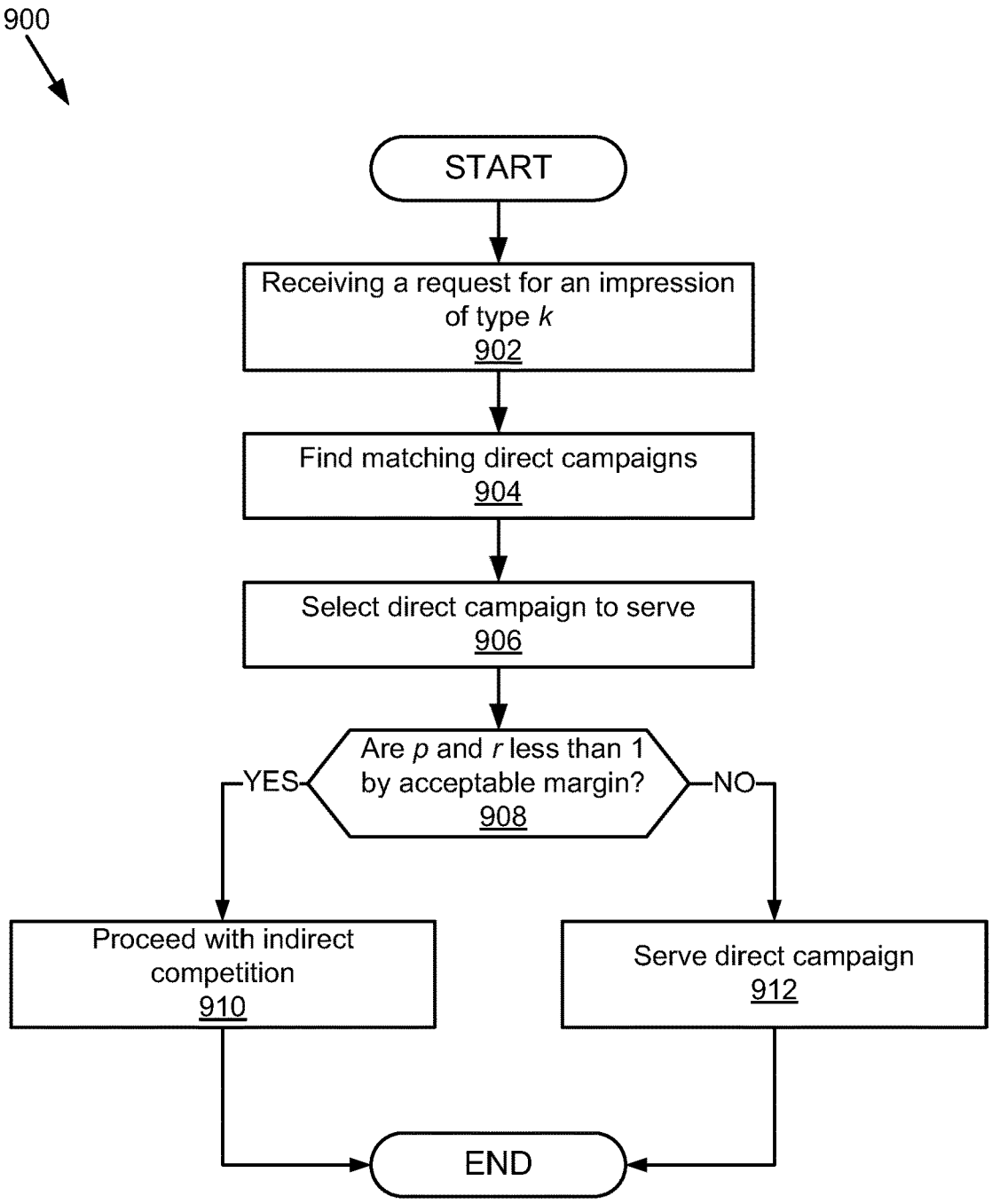
FIG. 9 is a flowchart illustrating a method for auctioning impressions according to one embodiment of the present invention.

Referring now to FIG. 9, a first embodiment of a method 900 for auctioning impressions is described. The method 900 begins by receiving 902 a request for an impression of type k. As has been noted above, k is a description of an impression at some level of granularity or set of attributes that define an impression. Next, the method 900 finds 904 matching direct campaigns that match the impression type of the request (direct campaigns that match k). Next the method 900 selects 906 a direct campaign to serve. In one embodiment, a prioritization engine (not shown) processes the sell through rate, the specific volume guaranteed (or goals) for each campaign, the price each was sold at, and the weighting assigned to them by the publisher, and other information and then assigns each campaign a priority that represents the percentage of matching inventory it needs to win to meet its goals. This priority is used along with impression classification to select a direct campaign to serve. Next the method determines 908 whether priority factor (p) of the selected direct campaign and the sum (r) of the priority factors for all matching campaigns are less than one by an acceptable margin. In one embodiment, the acceptable margin is chosen or predetermined based on their sell-through rates, buyer relationship, risk tolerance etc. If (p) and (r) are less than one by an acceptable margin the method proceeds 910 with the indirect competition. On the other hand, if (p) and (r) are not less than one by an acceptable margin, the method serves 912 to be direct campaign.

Figure 10A:
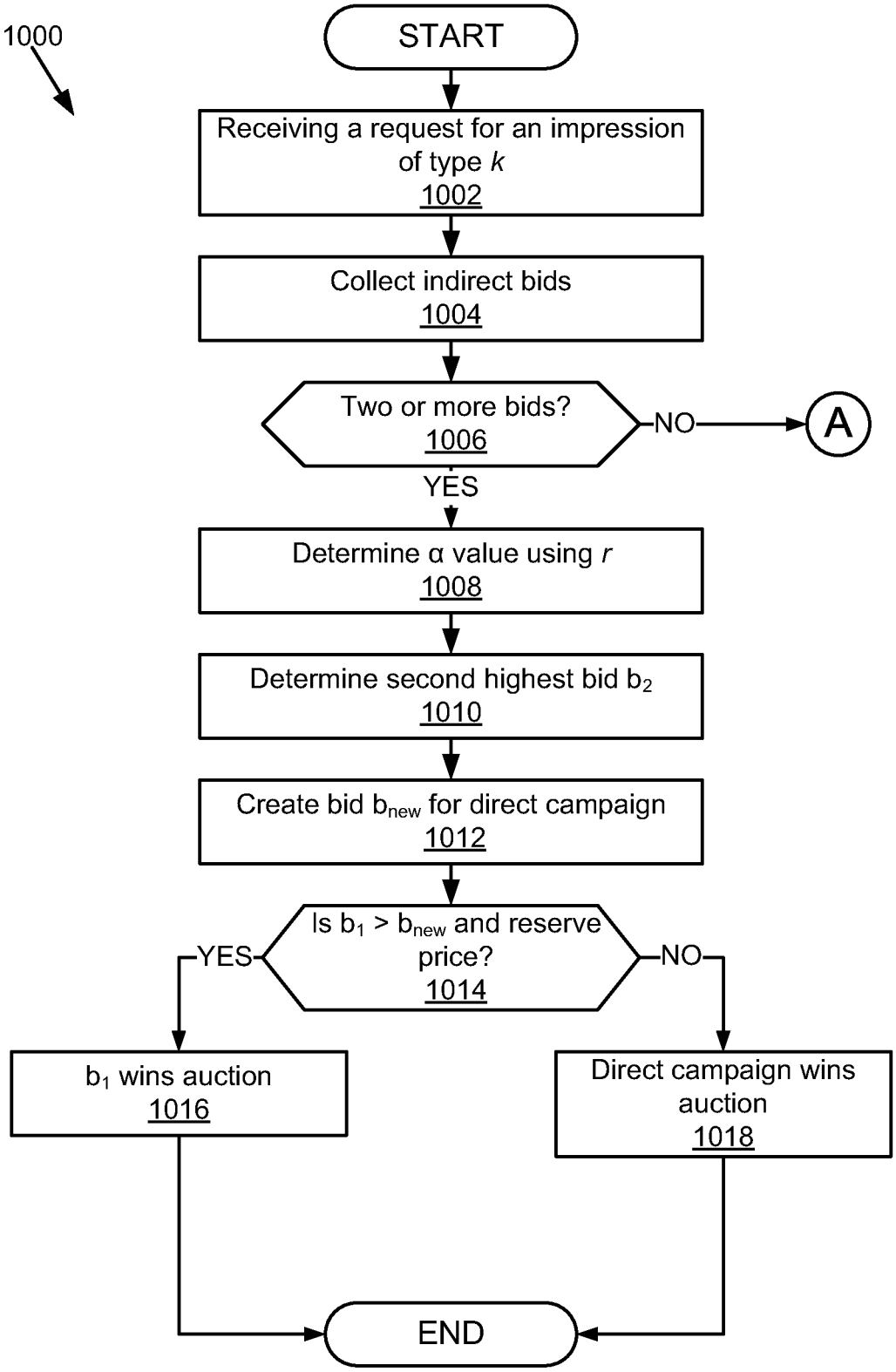
FIGS. 10A-10B are a flowchart illustrating a method for auctioning impressions according to a second embodiment of the present invention.

A second embodiment of the method 1000 for auctioning impressions is described below with reference to FIGS. 10A-10B. The method 1000 begins by receiving 1002 a request for an impression of type k. Next, the method collects 1004 indirect bids such as using the data collector 406 as described above for the delivery engine 202. The method 1000 continues by determining 1006 whether there are two or more bids. If not, the method 1000 continues as will be described below with reference to FIG. 10B. If there are two or more bids, the method 1000 determines 1008 the multiplier ($\alpha$) using the sum (r) of the priority factors for all matching campaigns and the alpha calculation module 602 as described above. Then the method 1000 determines 1012 a second highest bid ($b_2$). For example, the optimization engine 208 can retrieve this information from the statistical collector 204. Next, the method creates 1012 a new bid ($b_{new}$) that has a value ($\alpha \cdot b_2$) of the multiplier ($\alpha$) times the second-highest bid ($b_2$) and submits it to the auction. The multiplier ($\alpha$) is a number greater than one. This mitigates cherry picking by increasing the second highest value. The auction considers any bids for the same impression type k from indirect buyers collected by the bid collector 406. The auction then selects the highest bid ($b_1$). Next, the method determines 1014 whether the selected highest bid ($b_1$) is greater than the new bid ($b_{new}$) and is greater than the reserve price. For an indirect buyer to win, the buyer's private value must be greater than both the reserve price and the new bid. In one embodiment, reserve prices are determined as before (using the rate card, direct relationships that do not involve guarantees, bidder specific information, etc.), except no information about guarantees is included in the reserve price. If so, the highest selected bid ($b_1$) wins 1016 the auction and the impression corresponding to the highest selected bid ($b_1$) is selected and served in response to the request for the impression of type k. The price in the auction is the maximum of the reserve price and the new bid ($b_{new}$). On the other hand, if the selected highest bid ($b_1$) is not greater than the new bid ($b_{new}$) or the reserve price is not met, the direct campaign wins 1018 the auction and an impression from the direct campaign is served in response to the request for the impression of type k.

Figure 10B:
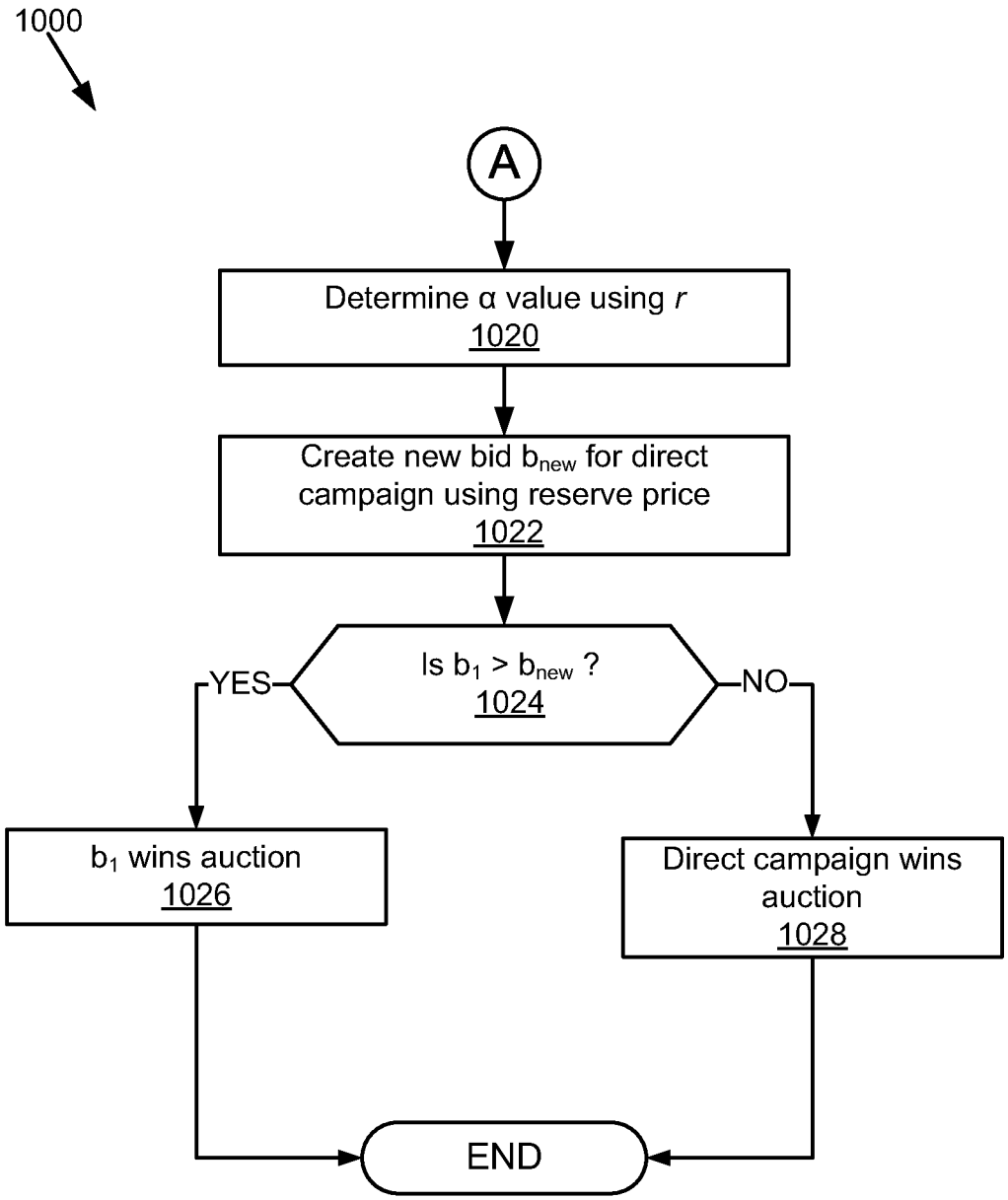

Referring now to FIG. 10B, the method continues from step 1006 in which it was determined that there were not two or more bids to step 1020. In step 1020, the method determines the multiplier ($\alpha$) using the sum (r). This is identical to step 1008 described above. The method continues by creating 1022 a new bid ($b_{new}$) for the direct campaign using the reserve price. The new bid ($b_{new}$) is equal to the multiplier ($\alpha$) times the reserve price. Since there is only one other bid in the auction, the new bid ($b_{new}$) is compared 1024 to the other bid which is by definition the highest selected bid ($b_1$). If the highest selected bid ($b_1$) is greater than the new bid ($b_{new}$), the highest selected bid ($b_1$) wins 1026 the auction and the impression corresponding to the highest selected bid ($b_1$) is selected and served in response to the request for the impression of type k. The price in the auction is equal to the multiplier ($\alpha$) times the reserve price. However, if the selected highest bid ($b_1$) is not greater than the new bid ($b_{new}$), the direct campaign wins 1028 the auction and an impression from the direct campaign is served in response to the request for the impression of type k.

Figure 11A:
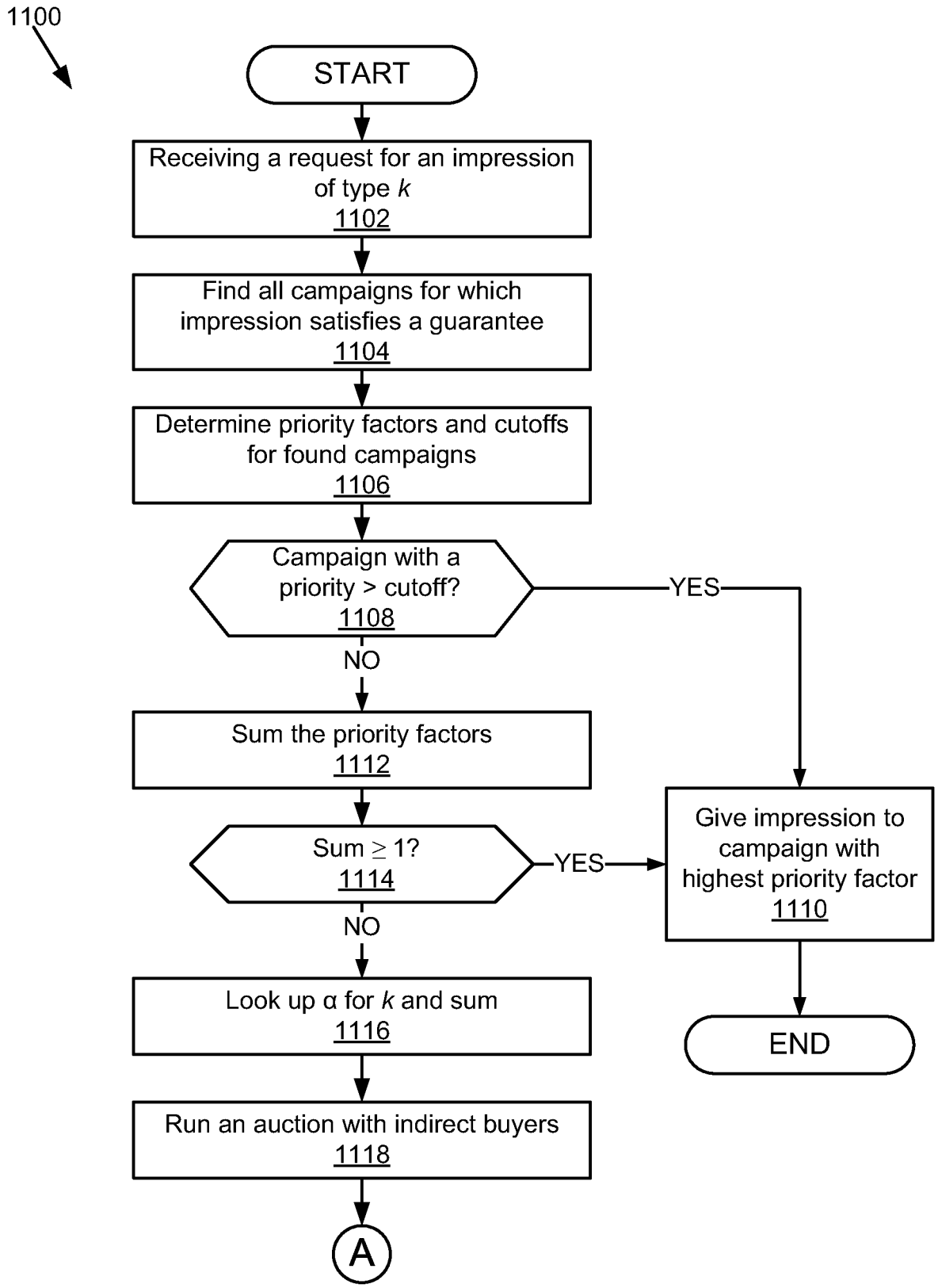
FIGS. 11A-11C are a flowchart illustrating a method for auctioning impressions according to a third embodiment of the present invention.
Figure 11B:
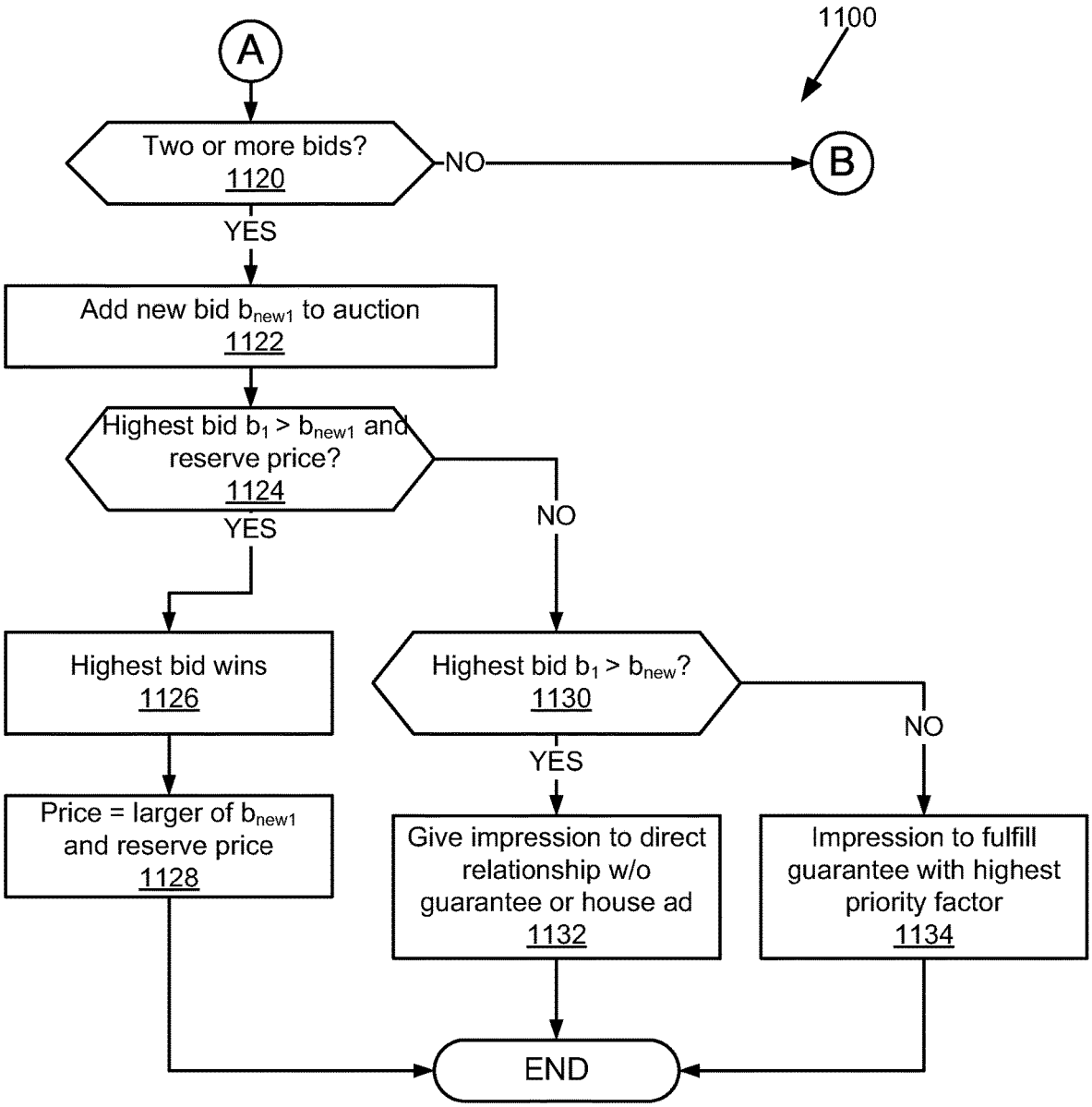

A third embodiment of the method 1100 for auctioning impressions is described below with reference to FIGS. 11A-11C. The method 1100 begins by receiving 1102 a request for an impression of type k. Next, the method finds 1104 the campaigns for which the impression could satisfy a guarantee. Next, the method determines 1106 priority factors and cutoffs for the campaigns found in step 1104. There is a priority factor for each campaign. The priority factor is a number between 0 and 1 that estimates the proportion of relevant impressions that need to be given to the campaign in the future in order to meet the campaign's guarantee. The method continues by determining 1108 whether any of the campaigns (from step 1104) have a priority factor greater than the cutoff. If so, the method proceeds to determine the campaign with the highest priority factor and then give 1110 the impression to that campaign with the highest priority factor. After step 1110, the process is complete and ends. On the other hand, if it was determined that there was not a campaign with a priority greater than the cutoff, the method sums 1112 the priority factors from all the campaigns of step 1104. The method then determines 1114 whether the sum is greater than or equal to one. If so, the method proceeds to determine 1110 the campaign with the highest priority factor and then give 1110 the impression to that campaign. However, if the sum is not greater than or equal to one, the method looks up 1116 multiplier ($\alpha$) for the k and the sum from step 1112. As will be described below, this can be looked up from a grid 1400 and is a number greater than one. Then the auction is run 1118 with indirect buyers and their bids are labeled from highest to lowest so that $b_1 > b_2 > \cdots > b_m$. Referring now also to FIG. 11B, the method transitions from step 1118 to step 1120. In step 1120, the method determines if there are two or more bids. If not, the method transitions to step 1136 of FIG. 11C as will be described in more detail below. If there are more than two bids, a first new bid ($b_{new1}$) is added 1112 to the auction. The first new bid ($b_{new1}$) has a price equal to the second highest bid ($b_2$) times the multiplier ($\alpha$). The method then determines 1124 whether the highest bid is greater than the first new bid ($b_{new1}$) and the reserve price. If so, the indirect buyer with the highest bid ($b_1$) wins 1126 the auction and the impression is awarded to the highest bid ($b_1$). The price for the impression 1128 is the larger of first new bid ($b_{new1}$) and the reserve price. If the highest bid ($b_1$) is not greater than both the first new bid ($b_{new1}$) and the reserve price, the method determines 1130 whether the highest bid ($b_1$) is greater than the first new bid ($b_{new1}$). If the highest bid ($b_1$) is greater than the first new bid ($b_{new1}$) but $b_1$ is not greater than the reserve price, then give 1132 the impression to a direct relationship that does not involve a guarantee (and hence is not part of step 2) or serves a house ad. However, if the highest bid ($b_1$) is not greater than the first new bid ($b_{new1}$), then the impression goes to fulfill the guarantee in step 1104 with the highest priority factor.

Figure 11C:
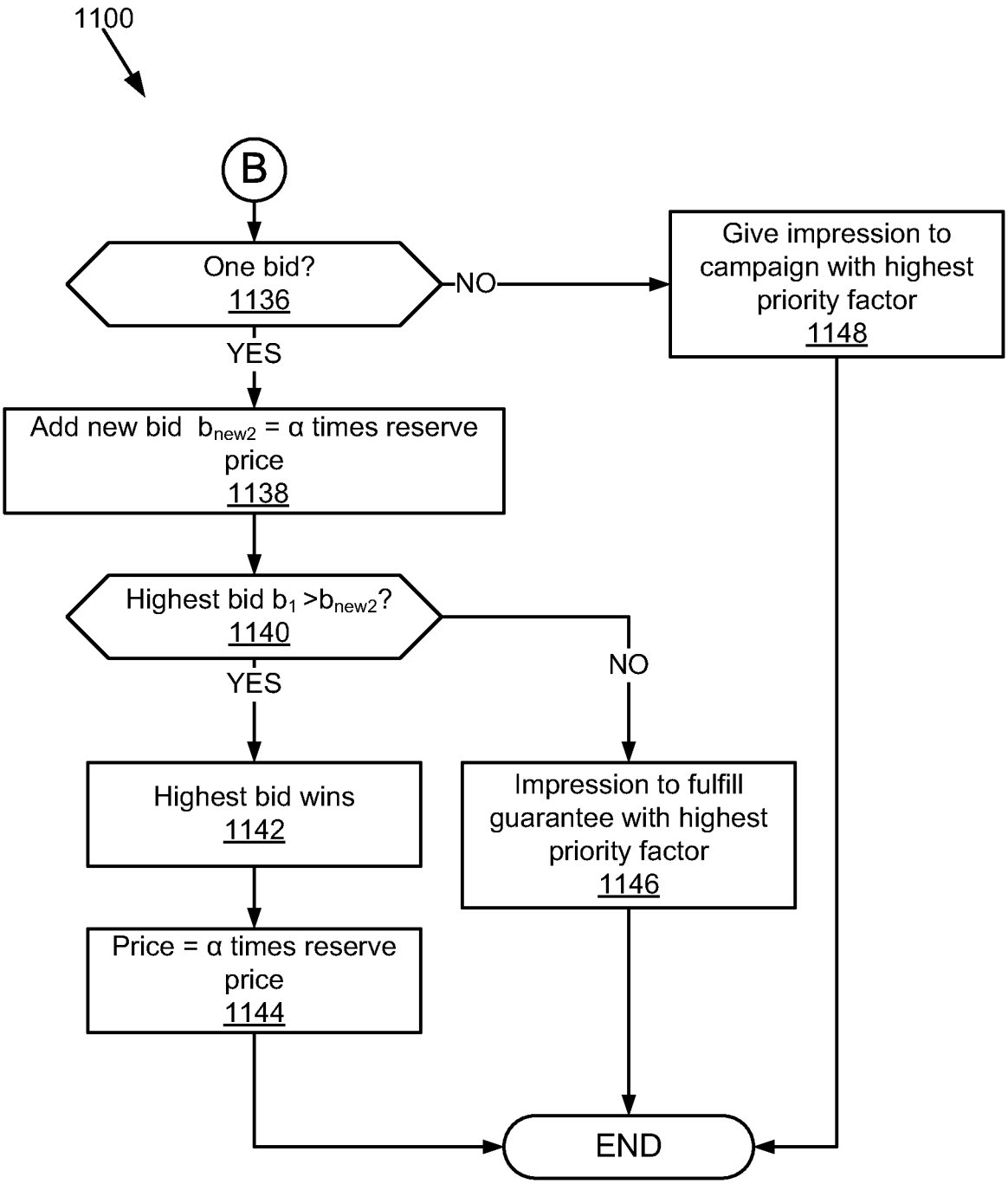

Referring now also to FIG. 11C, the method continues in step 1136 to determine if there is a single bid. If not, then the method gives 1148 the impression to the campaign with the highest priority factor and the method is complete. On the other hand, if there is a single bid, the method adds 1138 a new bid ($b_{new2}$) that has a price of the multiplier ($\alpha$) times the reserve price for the single bidder. The method continues to determine 1140 whether the highest bid ($b_1$), which in this case is the single bid, is greater than the new bid ($b_{new2}$). If so, the highest bid ($b_1$) wins 1142 the auction, and the price for the impression is the reserve price times $\alpha$. However, if the highest bid ($b_1$) is not greater than the new bid ($b_{new2}$), then give 1146 the impression to fulfill the guarantee in step 1104 with the highest priority factor, after which the method is complete and ends.

Referring now to FIG. 12, a method for optimizing allocation of impressions is described. The method begins by determining 1202 auction classifications or descriptions k. Then the method receives 1204 priority and cut off information. Next the method generates 1206 a grid of multiplier (α) values. This process is described in more detail below with reference to FIG. 13. The method then receives 1208 budget information from the forecasting module 206. The method then retrieves 1210 information about the second highest bids. For example the optimization engine 208 retrieves the information from the statistics collector 204. Finally, the method selects an α value using the information from steps 1206-1212. In an alternate embodiment, the method for optimizing the allocation of impressions includes the step of 1) determining auction classifications, 2) generating a grid of multipliers (α); 3) receiving priority and cutoff information; 4) receiving budget information; and 5) selecting a multiplier (α) value. Those skilled in the art will recognize that there are other modifications possible to the method that are encompassed by the present invention.

Figure 13:
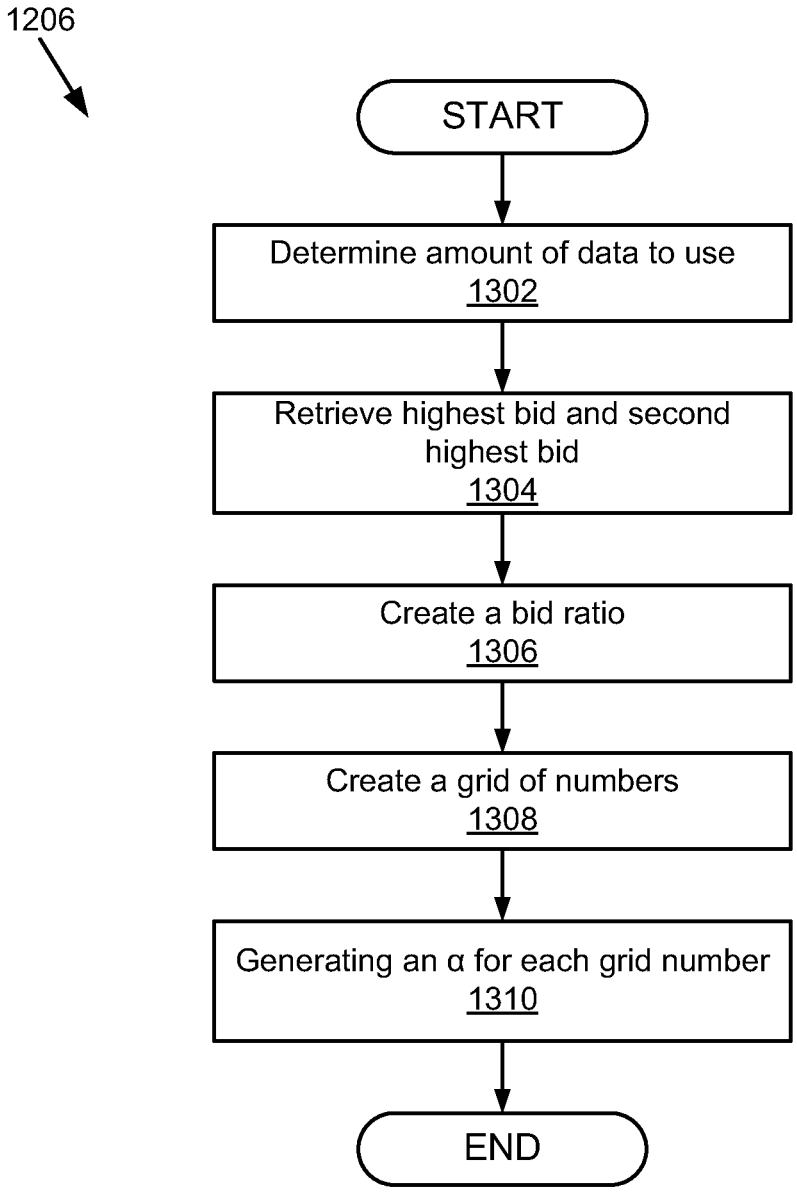
FIG. 13 is a flowchart illustrating a method for determining multipliers used in generating bids according to one embodiment of the present invention.

Referring now to FIG. 13, a method for determining multipliers used in generating bids is described. The method described below is a process for generating multipliers a for a single class of auction. Those skilled the art will recognize that in some embodiments this process is done separately for each class auctions. The method begins by determining 1302 an amount of past auction data (observations) to use (i.e. a week, a month, a year, etc.) and make it accessible. The data needs to be a good predictor of how bids will look in the future, so there needs to be enough observations/auctions that capture relevant impressions. Next the method retrieves 1304 a highest bid and a second highest bid. In one embodiment for every auction in the data set, the highest bid (a win bid) and the second-highest bid (a no win bid), if they exist, are determined and retrieved. If there are any auctions without a highest bid and a second highest bid, replace the missing data with that auction's reserve price. The method continues by creating 1306 a bid ratio. The bid ratio equals the highest bid divided by the second-highest bid. The observations are sorted from smallest to largest according to the bid ratio. Then the method creates 1308 a grid of numbers. In one embodiment, the grid of numbers is from 0 to 1, with spacing 0.001. There will be a multiplier α for each number between 0 and 1. It should be understood that the grid could have finer spacing. Finally, the method generates 1310 a multiplier α for each grid number. For every number g in the grid between 0 and 1, multiply g by the number of observations n. Find the (g·n)th bid ratio in the sorted list. That bid ratio is the a corresponding to the number g (and the class of data k being used). This produces a mapping from the numbers between zero and 1 to an α. These α are always 1 or larger. The upper bound on a is the largest observed bid ratio.

Figure 14:
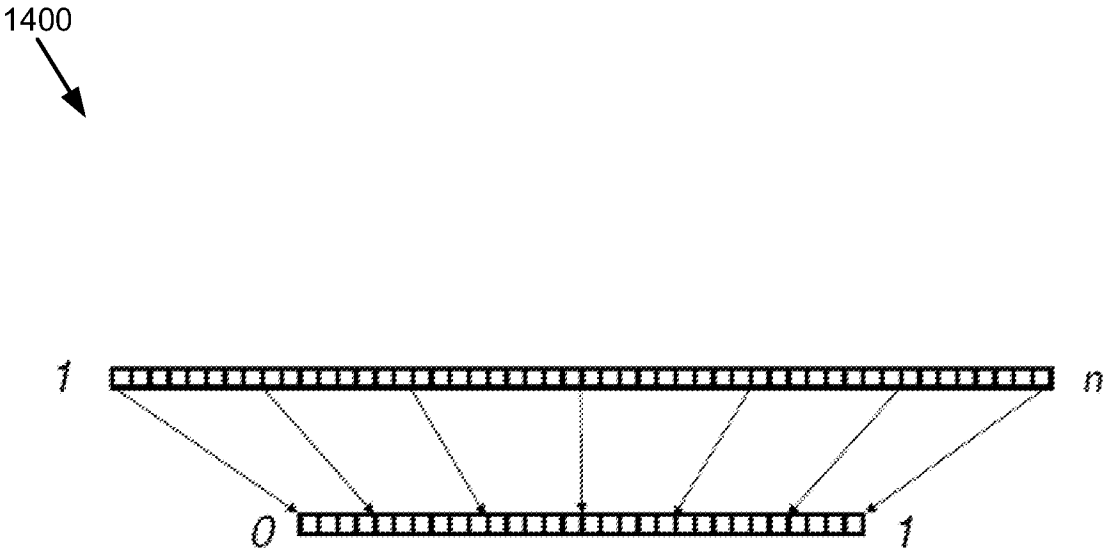
FIG. 14 is a diagram showing a grid of multipliers according to one embodiment of the present invention.

Referring now to FIG. 14, one example of a grid 1400 of multipliers produced according to the method of FIG. 13 is shown. As has been described above, for each auction that won an impression of type k, each winning bid is divided by the greater of the second-place bid and the reserve price. Then the values are sorted from smallest to largest into a list. As shown in FIG. 14, the list (1 to n) is mapped evenly to numbers between 0 and 1 with the smallest number mapped to 0 and the largest number of mapped to 1. The numbers between zero and one represent all possible values of the sum (r) of the matching campaign priority factors. The position of the intervals between 0 and 1 does not have to match the precision of r.

The foregoing description of the embodiments of the present invention has been presented for the purposes of illustration and description. It is not intended to be exhaustive or to limit the present invention to the precise form disclosed. Many modifications and variations are possible in light of the above teaching. It is intended that the scope of the present invention be limited not by this detailed description, but rather by the claims of this application. As will be understood by those familiar with the art, the present invention may be embodied in other specific forms without departing from the spirit or essential characteristics thereof. Likewise, the particular naming and division of the modules, routines, features, attributes, methodologies and other aspects are not mandatory or significant, and the mechanisms that implement the present invention or its features may have different names, divisions and/or formats. Furthermore, as will be apparent to one of ordinary skill in the relevant art, the modules, routines, features, attributes, methodologies and other aspects of the present invention can be implemented as software, hardware, firmware or any combination of the three. Also, wherever a component, an example of which is a module, of the present invention is implemented as software, the component can be implemented as a standalone program, as part of a larger program, as a plurality of separate programs, as a statically or dynamically linked library, as a kernel loadable module, as a device driver, and/or in every and any other way known now or in the future to those of ordinary skill in the art of computer programming. Additionally, the present invention is in no way limited to implementation in any specific programming language, or for any specific operating system or environment. Accordingly, the disclosure of the present invention is intended to be illustrative, but not limiting, of the scope of the present invention, which is set forth in the following claims.

What is claimed is:

1. An online impression-allocation method executing instantaneous advertisement placement on an impression-by-impression basis within a plurality of different electronic content accessible over a network, the method comprising:

receiving a first advertisement call with a first impression request with an impression description indicating a particular impression type and a value designation for said particular impression type;

receiving a second advertisement call with a second impression request with an impression description of another impression type and a value designation for said another impression type; and executing a delivery engine comprising a data processor and an executable code stored in a non-transitory computer-readable memory, the delivery engine creating and executing one or more control actions delivered via the network, further comprising the steps of:

1) responsive to the first advertisement call and the second advertisement call, simultaneously executing one or more impression-collection operations requesting bid data from a plurality of impression sources, the plurality of impression sources including an indirect demand source coupled to the delivery engine and a direct demand source coupled to the delivery engine;

2) executing an optimization engine coupled to the direct demand source and the indirect demand source via the network, the optimization engine further comprising:

a multiplier calculation module, operably coupled to a data retrieval module, a classification module, a priority module, and a budget smoothing module, the classification module receiving classification data, the priority module receiving priority data, the budget smoothing module receiving forecasting data and availability data, and said data retrieval module receiving historical information data and providing by at least the multiplier calculation module a set of parameters including priority data representative of a priority value and a cutoff, an alpha multiplier value, a reserve value, and a sell-through value that are sent to the direct demand source; and 3) the multiplier calculation module providing the set of parameters to a direct bid engine coupled to the direct demand source; and 4) the direct bid engine providing new direct bids that use said multiplier calculation module and a multiplier value, times a second-highest indirect bid value, wherein the optimization engine generates the multiplier value based upon a priority factor from said priority data;

executing a modified second-bid engine coupled to the direct demand source and the indirect demand source and selecting particular winning bid data from the new direct bids and indirect bids by matching direct demand or indirect demand to the particular impression type and the value designation of the first advertisement call, and the another impression type and the value designation of the second advertisement call, wherein the new direct bids are a homogenous function of degree one of other received bids, the winning bid data retrieving a highest bid value and a second-highest bid value and further creating a bid ratio that equals the highest bid value divided by the second highest bid value and in other instances using the reserve value; and serving, a particular impression corresponding to the winning bid data responsive to each of the first advertisement call and the second advertisement call and placing the particular impression within a particular electronic content from the plurality of different electronic content.

2. The online impression-allocation method of claim 1, wherein data representative of bids is a multiple of a second highest received bid data, and wherein the multiple is greater than 1.

3. The online impression-allocation method of claim 1, wherein said alpha multiplier value uses a sum of the priority data on all matching campaigns and the multiplier calculation module.

4. The online impression-allocation method of claim 1, wherein an advertisement processor of the delivery engine serves the impression and records information about serving of the impression in a storage device coupled to the delivery engine.

5. An impression-allocation system executing instantaneous advertisement placement on an impression-by-impression basis, within a plurality of different electronic content accessible over a network, the impression-allocation system comprising:

a data processor and a non-transitory computer-readable memory storing an executable code, the executable code causes the data processor to perform the steps of:

receiving a first advertisement call with a first impression request with an impression description indicating a particular impression type and a value designation for said particular impression type;

receiving a second advertisement call with a second impression request with an impression description of another impression type and a value designation for said another impression type; and executing a delivery engine, the delivery engine creating and executing one or more control actions delivered via the network, further comprising the steps of:

1) responsive to the first advertisement call and the second advertisement call, simultaneously executing one or more impression-collection operations requesting bid data from a plurality of impression sources, the plurality of impression sources including an indirect demand source coupled to the delivery engine and a direct demand source coupled to the delivery engine;

2) executing an optimization engine coupled to the direct demand source and the indirect demand source via the network, the optimization engine further comprising:

a multiplier calculation module, operably coupled to a data retrieval module, a classification module, a priority module, and a budget smoothing module, the classification module receiving classification data, the priority module receiving priority data, the budget smoothing module receiving forecasting data and availability data, and said data retrieval module receiving historical information data and providing by at least the multiplier calculation module a set of parameters including priority data representative of a priority value and a cutoff, an alpha multiplier value, a reserve value, and a sell-through value that are sent to the direct demand source; and 3) the multiplier calculation module providing the set of parameters to a direct bid engine coupled to the direct demand source; and 4) the direct bid engine providing new direct bids that use said multiplier calculation module and a multiplier value, times a second-highest indirect bid value, wherein the optimization engine generates the multiplier value based upon a priority factor from said priority data;

executing a modified second-bid engine coupled to the direct demand source and the indirect demand source and selecting particular winning bid data from the new direct bids and indirect bids by matching direct demand or indirect demand to the particular impression type and the value designation of the first advertisement call, and the another impression type and the value designation of the second advertisement call, wherein the new direct bids are a homogenous function of degree one of other received bids, the winning bid data retrieving a highest bid value and a second-highest bid value and further creating a bid ratio that equals the highest bid value divided by the second highest bid value and in other instances using the reserve value; and serving, a particular impression corresponding to the winning bid data responsive to each of the first advertisement call and the second advertisement call and placing the particular impression within a particular electronic content from the plurality of different electronic content.

6. The impression-allocation system of claim 5, wherein the bid data is a multiple of a second highest received bid data, and wherein the multiple is greater than 1.

7. The impression-allocation system of claim 5 wherein said alpha multiplier value is used to generate a sum of the priority data representative of a priority value and a cutoff on matching campaigns and the multiplier calculation module.

8. The impression-allocation system of claim 5, wherein an advertisement processor serves the advertisement and records information on serving of the advertisement.

* * * * *